US009399867B2

(12) United States Patent
Di Lorenzo

(10) Patent No.: US 9,399,867 B2
(45) Date of Patent: Jul. 26, 2016

(54) CONCRETE PANEL CORNER CONNECTION

(75) Inventor: Nick Di Lorenzo, Woodbridge (CA)

(73) Assignee: MILLWICK ACQUISITION CORP., Toronto (CA)

( * ) Notice: Subject to any disclaimer, the term of this patent is extended or adjusted under 35 U.S.C. 154(b) by 301 days.

(21) Appl. No.: 12/755,630

(22) Filed: Apr. 7, 2010

(65) Prior Publication Data

US 2010/0257805 A1 Oct. 14, 2010

Related U.S. Application Data

(60) Provisional application No. 61/167,383, filed on Apr. 7, 2009.

(51) Int. Cl.

| | |
|---|---|
| ***E06B 1/02*** | (2006.01) |
| ***E06B 1/04*** | (2006.01) |
| ***E04C 2/04*** | (2006.01) |
| ***E04C 2/38*** | (2006.01) |
| ***E04B 1/04*** | (2006.01) |

(52) U.S. Cl.

CPC ..... *E04C 2/382* (2013.01); *E04B 1/043* (2013.01)

(58) Field of Classification Search

CPC . E04B 1/04; E04B 2001/3583; E04B 1/4121; E04C 2/044; E04C 3/20

USPC ..... 52/250, 79.9, 220.2, 251, 252, 258, 52/266, 271, 275, 602

See application file for complete search history.

(56) References Cited

U.S. PATENT DOCUMENTS

| | | | | |
|---|---|---|---|---|
| 1,410,453 | A * | 3/1922 | Butcher | 52/250 |
| 1,924,801 | A | 8/1933 | Olmsted | |
| 2,043,697 | A | 6/1936 | Deichmann | |
| 2,078,144 | A | 4/1937 | Kenan | |
| 2,202,745 | A | 3/1940 | Muse | |
| RE21,905 | E | 9/1941 | Nielsen | |
| 2,262,899 | A | 11/1941 | Mechlin | |
| 2,270,846 | A | 1/1942 | Hines | |
| 2,321,813 | A | 6/1943 | Henzel | |
| 2,515,977 | A | 7/1950 | Banneyer | |
| 2,983,983 | A | 5/1961 | Mayer | |
| 3,232,018 | A | 2/1966 | MacKean | |

(Continued)

FOREIGN PATENT DOCUMENTS

| | | |
|---|---|---|
| CA | 2078381 | 3/1993 |
| CA | 2240098 A1 | 12/1999 |

(Continued)

OTHER PUBLICATIONS

English Abstract of JP 10252278 to Sekisui House Ltd.

(Continued)

*Primary Examiner* — Elizabeth A Quast
*Assistant Examiner* — Kyle Walraed-Sullivan

(57) ABSTRACT

Two building panels are connected through a column. One panel is bolted to the column, for example by way of fasteners passing through holes in a rib of the panel into threaded inserts in the column. A second panel is also bolted to the column, for example to threaded inserts open to another face of the column. Further panels in an upper or lower story of a building may be connected to the same column such that vertically stacked panels are connected together. In another connection, one end rib of a panel is made to receive a second panel. The second panel can be attached to the end rib of the first panel to make a corner.

7 Claims, 31 Drawing Sheets

(56) References Cited

U.S. PATENT DOCUMENTS

| | | | | | |
|---|---|---|---|---|---|
| 3,281,510 | A | | 10/1966 | Lovret | |
| 3,350,824 | A | * | 11/1967 | Wiebusch | 52/251 |
| 3,475,529 | A | | 10/1969 | Lacy | |
| 3,683,578 | A | | 8/1972 | Zimmerman | |
| 3,780,977 | A | | 12/1973 | Dashew | |
| 3,782,061 | A | * | 1/1974 | Minutoli et al. | 52/125.5 |
| 3,785,608 | A | | 1/1974 | Heinzman et al. | |
| 3,804,361 | A | | 4/1974 | Camus | |
| 3,844,524 | A | | 10/1974 | Fisher et al. | |
| 3,881,856 | A | | 5/1975 | Fougea | |
| 3,885,369 | A | | 5/1975 | Ott | |
| 3,959,940 | A | | 6/1976 | Ramberg | |
| 3,979,863 | A | | 9/1976 | Hurley et al. | |
| 4,019,293 | A | | 4/1977 | Armas | |
| 4,030,262 | A | | 6/1977 | Dean | |
| 4,067,941 | A | | 1/1978 | Gaudelli et al. | |
| 4,073,102 | A | * | 2/1978 | Fisher | 52/79.13 |
| 4,112,646 | A | | 9/1978 | Clelland | |
| 4,157,640 | A | | 6/1979 | Joannes | |
| 4,178,343 | A | | 12/1979 | Rojo, Jr. | |
| 4,182,092 | A | | 1/1980 | Weaver | |
| 4,191,521 | A | | 3/1980 | Muldery et al. | |
| 4,211,043 | A | | 7/1980 | Coday | |
| 4,219,978 | A | | 9/1980 | Brown | |
| 4,290,246 | A | | 9/1981 | Hilsey | |
| 4,320,606 | A | | 3/1982 | GangaRao | |
| 4,336,676 | A | | 6/1982 | Artzer | |
| 4,374,635 | A | | 2/1983 | Carucci et al. | |
| 4,454,702 | A | | 6/1984 | Bonilla-Lugo et al. | |
| 4,485,598 | A | * | 12/1984 | Guardiani | 52/79.1 |
| 4,530,191 | A | | 7/1985 | Boisbluche | |
| 4,554,124 | A | | 11/1985 | Sudrabin | |
| 4,570,398 | A | | 2/1986 | Zimmerman | |
| 4,605,529 | A | | 8/1986 | Zimmerman | |
| 4,611,450 | A | | 9/1986 | Chen | |
| 4,614,013 | A | | 9/1986 | Stevenson | |
| 4,669,240 | A | | 6/1987 | Amormino | |
| 4,731,915 | A | | 3/1988 | Holder | |
| 4,751,803 | A | | 6/1988 | Zimmerman | |
| 4,759,160 | A | | 7/1988 | Fischer | |
| 4,781,006 | A | | 11/1988 | Haynes | |
| RE32,936 | E | | 5/1989 | Smith | |
| 4,901,491 | A | | 2/1990 | Phillips | |
| 4,934,121 | A | | 6/1990 | Zimmerman | |
| 4,951,438 | A | * | 8/1990 | Thoresen | 52/252 |
| 4,998,393 | A | | 3/1991 | Baena | |
| 5,055,252 | A | | 10/1991 | Zimmerman | |
| 5,058,345 | A | | 10/1991 | Martinez | |
| 5,183,616 | A | | 2/1993 | Hedrick | |
| 5,222,338 | A | | 6/1993 | Hull et al. | |
| 5,261,198 | A | * | 11/1993 | McMillan | 52/127.12 |
| 5,317,848 | A | | 6/1994 | Abbey | |
| 5,335,472 | A | | 8/1994 | Phillips | |
| 5,381,635 | A | | 1/1995 | Sanger | |
| 5,398,470 | A | | 3/1995 | Ritter et al. | |
| 5,433,504 | A | | 7/1995 | Kao | |
| 5,493,838 | A | | 2/1996 | Ross | |
| 5,501,055 | A | | 3/1996 | Storch et al. | |
| 5,566,520 | A | | 10/1996 | Branitzky | |
| 5,656,194 | A | | 8/1997 | Zimmerman | |
| 5,865,001 | A | | 2/1999 | Martin et al. | |
| 5,881,519 | A | * | 3/1999 | Newkirk | 52/274 |
| 5,927,043 | A | | 7/1999 | Newkirk | |
| 5,950,390 | A | | 9/1999 | Jones | |
| 5,953,864 | A | | 9/1999 | Beck | |
| 6,003,278 | A | | 12/1999 | Weaver et al. | |
| 6,058,672 | A | * | 5/2000 | McClellan | 52/587.1 |
| 6,101,779 | A | * | 8/2000 | Davenport | 52/602 |
| 6,112,489 | A | | 9/2000 | Zweig | |
| 6,151,843 | A | | 11/2000 | Weaver et al. | |
| 6,260,320 | B1 | | 7/2001 | DiLorenzo | |
| 6,338,231 | B1 | | 1/2002 | Enriquez | |
| 6,401,417 | B1 | | 6/2002 | Leblang | |
| 6,427,406 | B1 | | 8/2002 | Weaver et al. | |
| 6,463,702 | B1 | | 10/2002 | Weaver et al. | |
| 6,550,215 | B1 | | 4/2003 | Pulte et al. | |
| 6,629,388 | B2 | * | 10/2003 | Cohen | 52/79.9 |
| 6,647,678 | B1 | * | 11/2003 | Zambelli et al. | 52/252 |
| 6,698,150 | B1 | | 3/2004 | DiLorenzo | |
| 7,017,316 | B2 | | 3/2006 | Di Lorenzo | |
| 7,182,307 | B2 | | 2/2007 | Baker et al. | |
| 7,331,148 | B2 | * | 2/2008 | Di Lorenzo | 52/481.1 |
| 7,523,591 | B2 | * | 4/2009 | Di Lorenzo | 52/414 |
| 7,828,544 | B2 | * | 11/2010 | Di Lorenzo | 425/441 |
| 2003/0093965 | A1 | * | 5/2003 | Miller | 52/600 |
| 2003/0163963 | A1 | * | 9/2003 | Pulte et al. | 52/250 |
| 2006/0137269 | A1 | * | 6/2006 | Di Lorenzo | 52/250 |
| 2007/0028541 | A1 | * | 2/2007 | Pasek | 52/250 |
| 2010/0257805 | A1 | * | 10/2010 | Di Lorenzo | 52/477 |

FOREIGN PATENT DOCUMENTS

| | | | |
|---|---|---|---|
| CA | 2274287 | A1 | 12/1999 |
| CH | 644300 | | 7/1984 |
| DE | 2017109 | | 11/1970 |
| DE | 2254174 | | 5/1974 |
| DE | 2951898 | | 7/1980 |
| DE | 3413305 | | 10/1984 |
| EP | 0818287 | | 1/1998 |
| FR | 483834 | | 8/1917 |
| FR | 863026 | | 3/1941 |
| FR | 898765 | | 5/1945 |
| FR | 1422473 | | 12/1965 |
| FR | 2045625 | | 3/1971 |
| FR | 2163897 | | 7/1973 |
| FR | 2192486 | | 2/1974 |
| FR | 2560621 | | 9/1985 |
| GB | 1119057 | | 11/1965 |
| JP | 10252278 | | 9/1998 |
| WO | 9429090 | | 12/1994 |
| WO | WO 2007134518 | A1 * | 11/2007 |

OTHER PUBLICATIONS

Weaver Precast & Florida, Inc.: "Epic Wall System".

* cited by examiner

CONCRETE PANEL CORNER CONNECTION

This application claims the benefit under 35 USC 119(e) of U.S. Provisional Application No. 61/167,383 filed Apr. 7, 2009.

FIELD

This specification relates to building systems using wall panels.

BACKGROUND

Concrete panel systems have been used primarily to provide pre-manufactured walls for residential or small commercial or industrial buildings. Such systems promise a more accurate building, reduced on-site building time and waste, insect resistance and a hedge against rising lumber prices.

U.S. Pat. No. 3,475,529 describes a method of making a prestressed hollow core concrete panel. A first section is formed comprising a slab having a flat outer face and a plurality of ribs extending from an inner face. This first section is then laid ribs down on a second section, which is either a flat slab or a duplicate of the first section laid ribs up. The two sections are joined together. In an embodiment, the cores of the panel are closed.

U.S. Pat. No. 3,683,578 describes a concrete panel building system in which the panels have an inner insulating layer sandwiched between concrete layers. The space between the concrete layers cooperates with a guide nailed to a foundation to align the wall panels on the foundation. Upper portions of adjacent wall panels are secured together by a various bolted connections.

U.S. Pat. Nos. 4,605,529, 4,751,803 and 4,934,121 describe concrete wall panels having vertical ribs extending between horizontal upper and lower beams all attached to a concrete slab which provides the outer surface of the wall. The ribs and beams of the panels are reinforced by longitudinal reinforcing bars and the concrete slab is reinforced by a wire mesh. A "bolting saddle" cast into the ends of the upper beams allows adjacent panels to be bolted together. U.S. Pat. No. 5,656,194 describes an improved assembly jig having hinged sidewalls for use in making such panels.

U.S. Pat. No. 5,493,838 describes a method of constructing a basement from prefabricated concrete panels. The building site is first excavated and footings are positioned in the excavation to define the outline of the building. The footings have a groove in their upper surface to accept wall sections which comprise a slab having a flat outer face and a plurality of ribs on an inner face. Freestanding corner wall sections are placed first on the footings. Flat wall panels are then joined end-to-end between the corner sections to complete a peripheral wall. A conventional wooden floor deck is constructed over the peripheral wall to strengthen the structure before the basement is backfilled.

Introduction

The following summary is intended to introduce the reader to the detailed description and not to limit or define any claimed invention. The following summary may not describe all necessary features of the invention which may reside in a sub combination of the following features or in a combination with features described in other parts of this document.

A concrete panel construction system is described in U.S. Pat. No. 7,017,316 B2, by Nick DiLorenzo, issued on Mar. 28, 2008, which is incorporated herein in its entirety by this reference to it. That patent describes a concrete building panel having a slab and a plurality of ribs and beams. The ribs include interior ribs and end ribs which are generally perpendicular to the slab and oriented vertically in an installed panel. The beams include an upper and lower beam which are generally perpendicular to the slab and oriented horizontally in an installed panel. These panels may be connected together, among other ways, by fasteners applied through holes in the end ribs.

The following description describes further methods and apparatus of connecting building panels together. These methods and apparatus make use of holes in the end rib of a panel. These methods and apparatus may be used with a concrete building panel as described above, or with other panels have end ribs that can be provided with holes for fasteners.

In one connection, two panels are connected through a column. One panel is connected to the column, for example by way of fasteners passing through holes in a rib of the panel into threaded inserts in the column. A second panel is also connected to the column, for example to threaded inserts open to another face of the column. In this way, two panels are attached together. The panels may be attached to opposed sides of the column to make a straight wall or to orthogonal sides of the column to make an interior or exterior corner. The column may extend upwards or downwards above or below the panels. Further panels in an upper or lower story of a building may be connected to the same column such that vertically stacked panels are connected together.

In another connection, one end rib of a first panel is made to fit against the end of a second panel. The end rib of the first panel may be as wide, or wider, then than the thickness of the second panel. An inside or outside surface of the end rib of the first panel may be recessed relative to the remainder of the panel. For example, the end rib of the first panel may be made with a rabbet approximately equal in width to the thickness of the second panel. The second panel can be attached to the end rib of the first panel to make a corner. The connection can be made, for example, by fasteners inserted through holes in an end rib of the second panel into threaded inserts in the end rib of the first panel.

DETAILED DESCRIPTION

General Structure of Concrete Panels

Figure 1:
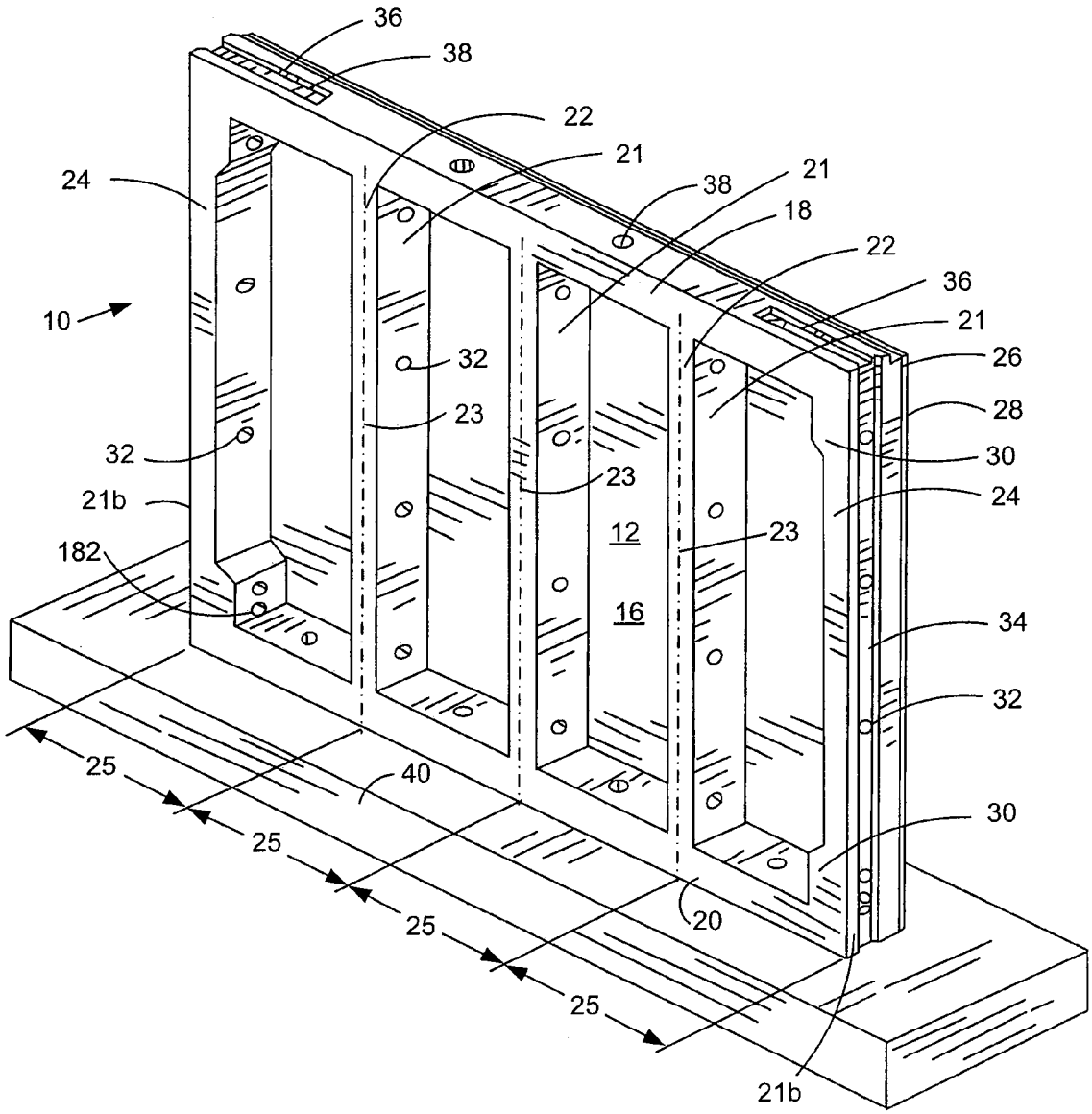
FIG. 1 is a perspective view of a first panel.
Figure 1A:
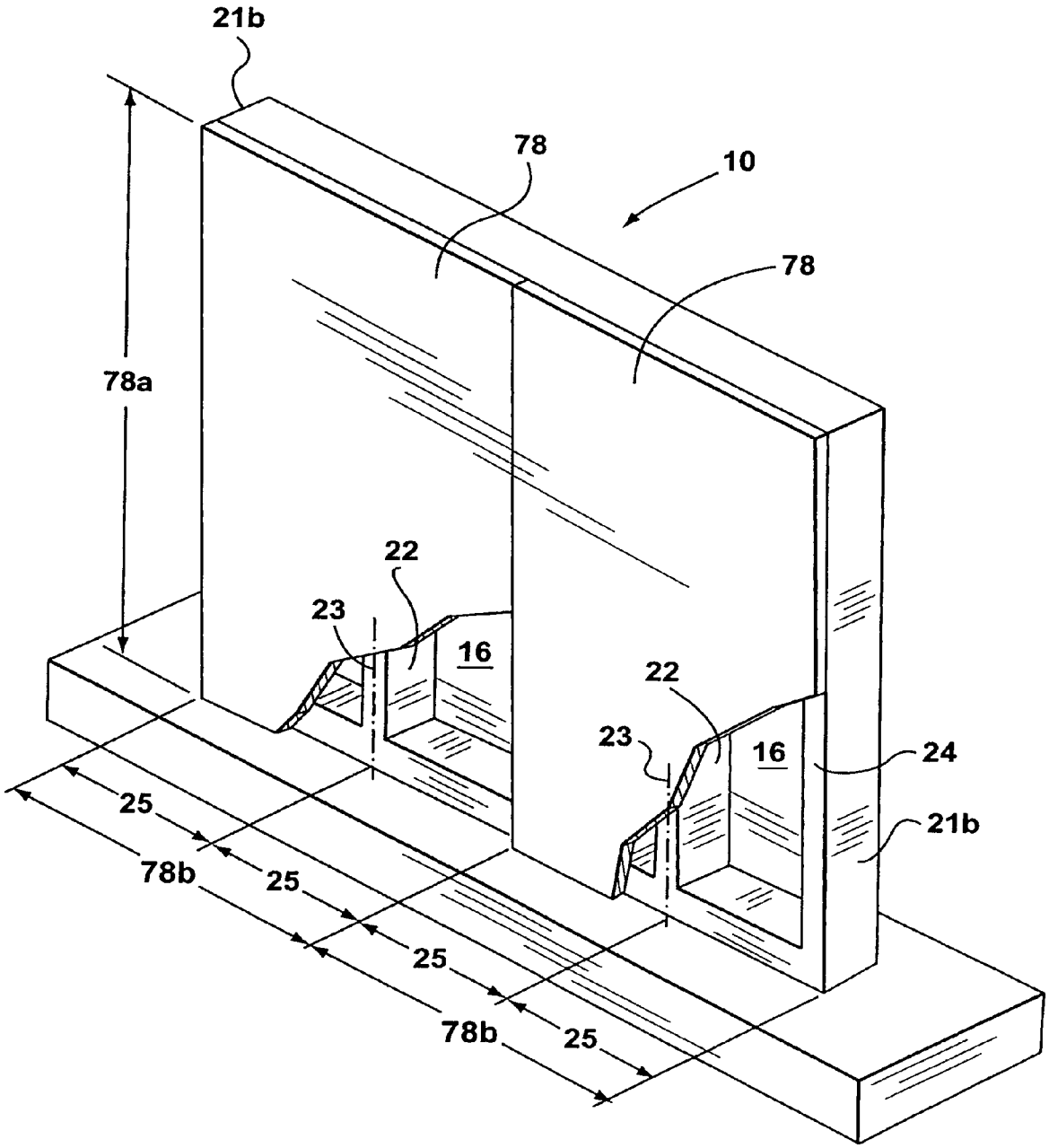
FIG. 1*a* is a perspective view of the panel of FIG. 1 with a sheet material attached to it.
Figure 2:
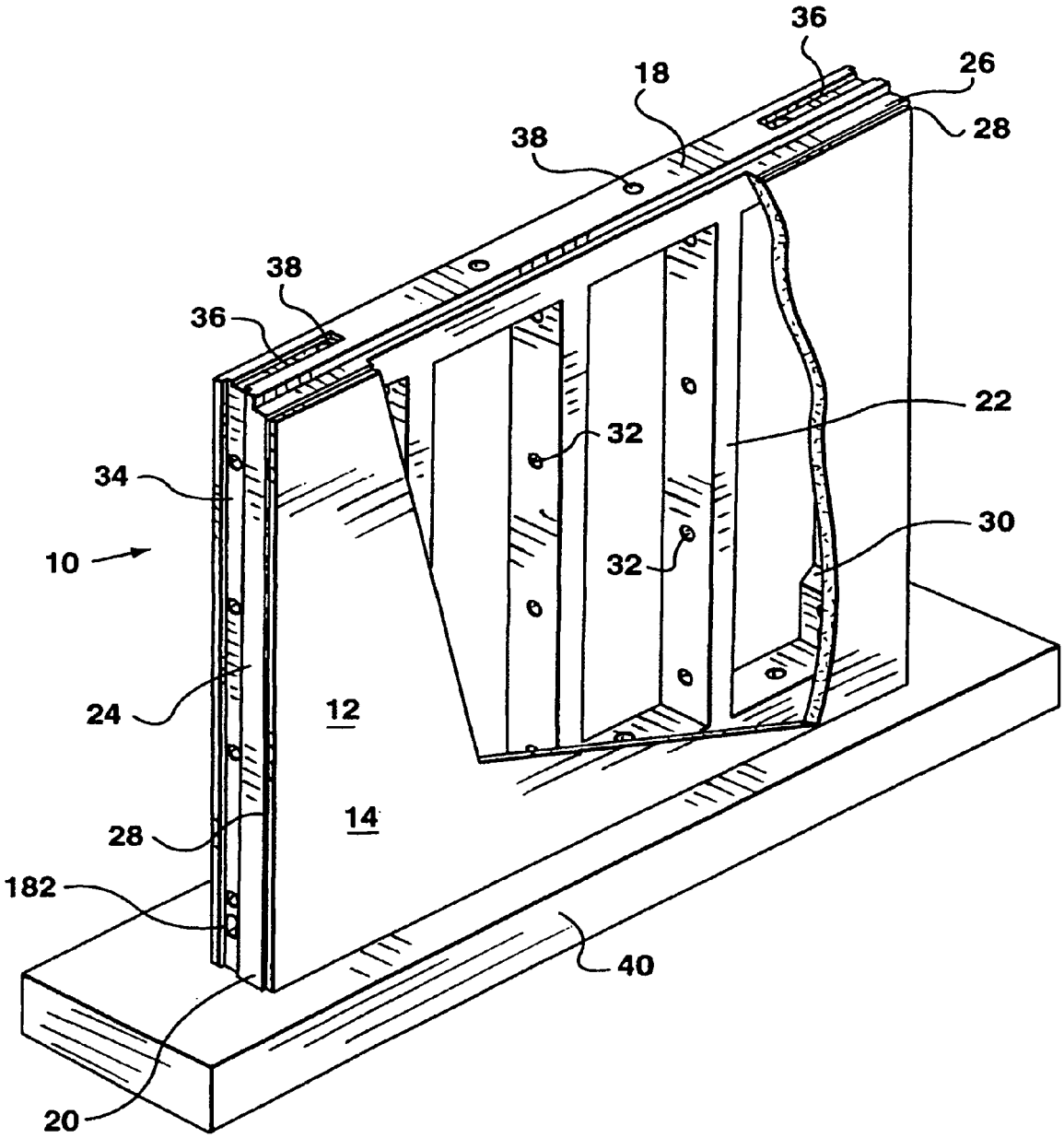
FIG. 2 is a perspective cutaway view of the first panel.
Figure 3:
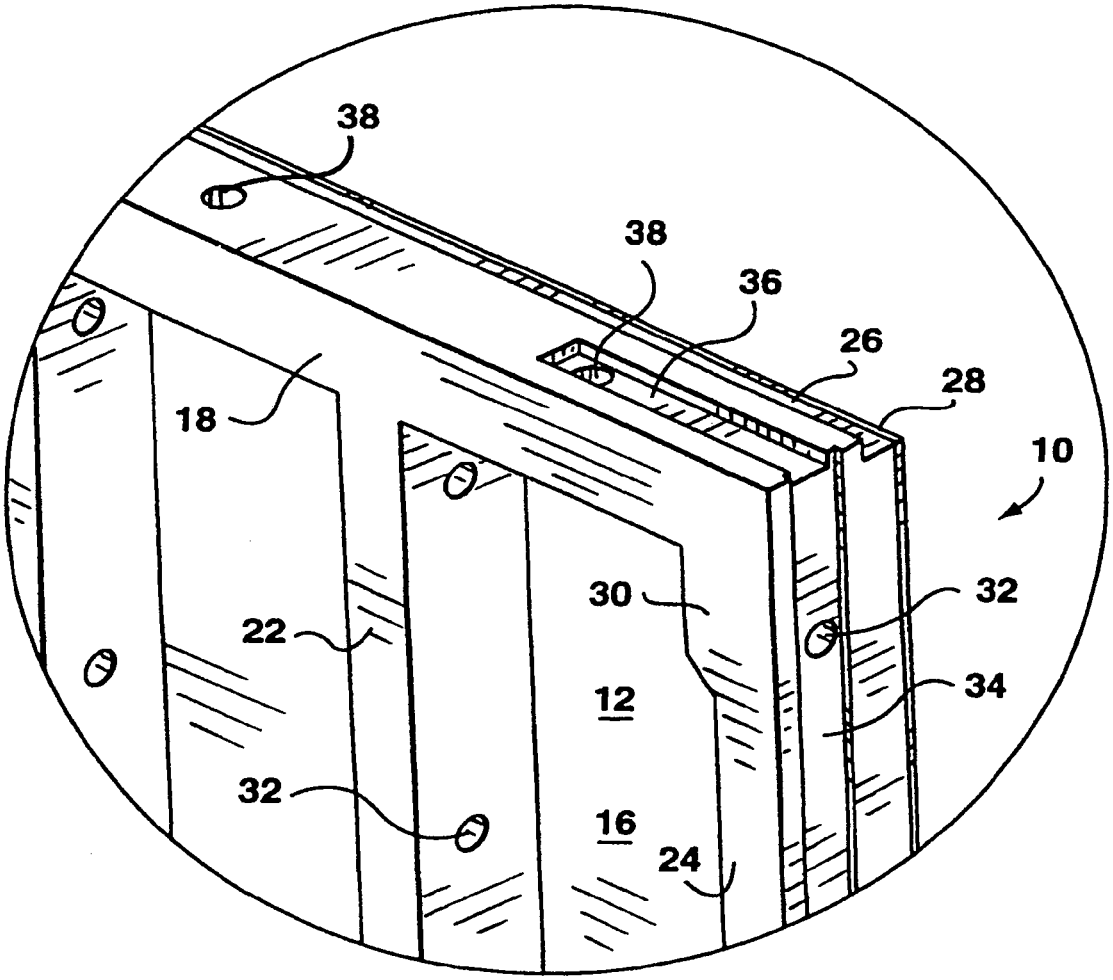
FIGS. 3 and 4 are perspective views of a corner of a first panel.
Figure 4:
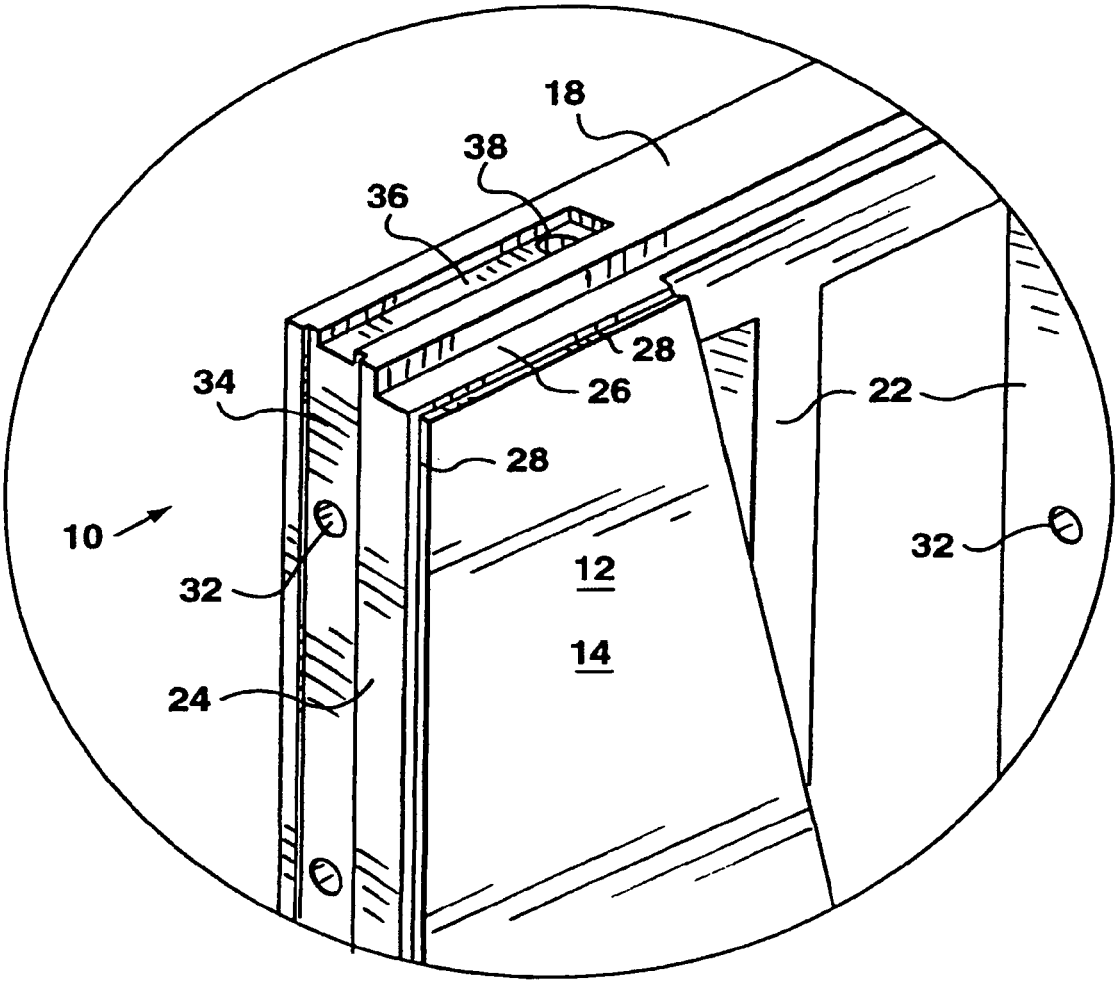

FIGS. 1 through 4 show a first panel 10 which is particularly useful for constructing basement walls. The first panel 10 comprises a slab 12 having an outside face 14 and an inside face 16. The slab 22 is typically one and a half to three inches thick. The outside face 14 of the panel 10 is typically also installed so that is also the outside face of a wall. The outside face 14 may be finished with a variety of architectural finishes or treatments such that the first panel 10 is both aesthetic and structural. Alternatively, however, the outside face 14 may be made to be the inside of a wall if appropriate modifications are made to the description below.

The slab 12 is integrally connected to a top beam 18 and bottom beam 20 which extend from the inside face 16 of the slab 12. Beams 18, 20 are generally perpendicular to the slab 12 and are generally horizontal in an installed first panel 10. Beams 18, 20 are typically about 2.5 inches thick, the thickness varying with their expected loading. The slab 12 and beams 18, 20 are integrally connected to interior ribs 22 and end ribs 24 which also extend from the inside face 16 of the slab 12. Ribs 22, 24 have side surfaces 21 extending from and generally perpendicular to the slab 12 and are generally vertical in an installed first panel 10. Interior ribs 22 have centerlines 23 extending along their length midway between side surfaces 21 and are typically spaced apart at a spacing interval 25 to conveniently accommodate the attachment of whole sheets of common sheet materials 78, such as drywall or plywood, having standard length and width dimensions 78*a* and 78*b* respectively. End ribs 24 have distal side surfaces 21 and are typically spaced so that centerlines 23 of interior ribs 22 and distal side surfaces 21 of adjacent end ribs 24 are spaced apart at spacing interval 25. Spacing interval 25 is a fraction of one of the standard length and width dimensions 78*a* and 78*b* of common sheet materials 78, wherein the fraction has a numerator of 1 and a denominator equal to a whole number. For example, in countries where sheet materials 78 often have standard width dimensions 78*b* of four feet and standard length dimensions 78*a* of eight feet, the spacing interval 25 between the centerlines 23 of adjacent interior ribs 22 or between the centerline 23 of an interior rib 22 and the distal side surface 21 of an adjacent end rib 24 is typically ½, ⅓, or ¼ of 4 feet, which corresponds to 24, 16, or 12 inches, respectively. Alternatively, the spacing interval 25 could be based on the 8 foot dimension of the common sheet materials, providing a spacing interval 25 of, for example, ¼, ⅕, or ⅙ of 8 feet, which corresponds to 24, 19.2 or 16 inches. The ribs 22, 24 typically range from 1.5 to 2.5 inches in thickness depending on their expected loading.

The length of the first panel 10 is variable but limited by the equipment available to physically handle the first panel 10. For house construction, a standard first panel 10 is typically eight feet wide. For commercial or industrial construction where heavier cranes are likely available, standard first panels 10 may be 12 or 16 feet long. The height of a first panel 10 may also vary from a typical height of eight feet to ten feet or more for buildings with high ceilings. The width of a first panel 10 is typically ten inches for residential basements but may vary for particular applications. To simplify the following discussion, the first panel 10 will be assumed to be 8 feet long by 8 feet high by 10 inches thick and to have three interior ribs 22 and two end ribs 24 spaced to provide support for sheet materials every 24 inches. For first panels 10 of other basic dimensions or configurations, parts of the description below may be modified as required.

The upper surface of the top beam 18 preferably has a major rabbet 26 opening to the outside face 14 of the first panel 10. The major rabbet 26 is typically about 3.5 inches wide and 1.5 deep. The major rabbet 26 receives the exterior sheathing or finish material of an adjacent upper wall structure. This makes it difficult for water running down that sheathing or finish material to enter the building by flowing across the upper surface of the top beam 18. The first panel 10 is also surrounded by a minor rabbet 28 (best shown in FIGS. 3 and 4) opening to the outside face 14 of the first panel 10. This minor rabbet 28 is typically about ⅛ inch deep and provides a recess to receive a cord and caulking. The cord and caulking help keep water out of the joint between a first panel 10 and adjacent first panels 10 or other building elements. With the minor rabbet 28, adjacent panels 10 can be butted directly against each other instead of placing adjacent panels with a slight gap between them for cord and caulking as in typical prefabricated panel construction.

The tops and bottoms of the end ribs 24 preferably include a widened portion 30 extending into the beams 18, 20. This widened portion 30 provides space for increased interior metal reinforcement as well as more concrete to strengthen the corners of the first panel 10.

The ribs 22, 24 are each provided with an equal number of horizontal holes 32 located at substantially the same elevations. These horizontal holes 32 have an appreciable diameter, typically about two and one eighth inches. As will be discussed further below, the horizontal holes 32 are used to attach a first panel 10 to an adjacent wall panel and at least one horizontal hole 32 preferably extends through each widened portion 30. The horizontal holes 32 also provide space to run electrical wiring or plumbing etc. through first panels 10. The vertical spacing of the horizontal holes 32 is preferably determined as follows. A nominal spacing is selected which gives an acceptable number of horizontal holes 32. A first hole, which can be the highest or lowest horizontal hole 32, is located so that its centre is at least a few inches from the closest beam 18, 20 and the centre of a last whole will also be at least a few inches from the closest beam 18, 20. Other horizontal holes 32 are placed with their centres at a multiple of the nominal spacing from the first hole. For example, an first panel eight feet high typically has horizontal holes 32 located at one foot, three feet, five feet and seven feet from the top or bottom of the first panel 10.

The end ribs 24 have vertical channels 34 in their outer sides preferably extending along their entire length. The vertical channels 34 cross the faces of the horizontal holes 32. The vertical channels 34 are typically about ¼ inch deep and four inches wide. The vertical channels 34 continue into horizontal channels 36 in the upper surfaces of the top beam 18 and, optionally, the lower surfaces of the bottom beam 20. The horizontal channels 36 are typically narrower than the vertical channels 34. The horizontal channels 36 extend from the vertical channels 34 to a proximal vertical hole 38.

Other vertical holes 38 are also provided in the beams 18, 20. These vertical holes 38 may be of the same size as the horizontal holes 32 and serve a similar purpose. An exception, however, is vertical holes 38 in a beam 18, 20 that do not intersect a horizontal channel 36 and are not used to provide a conduit for services. Such vertical holes 38 may be of a smaller diameter and may be located on different spacings. Vertical holes 38 may be used to attach a first panel 10 to a foundation or other building element.

Figure 5:
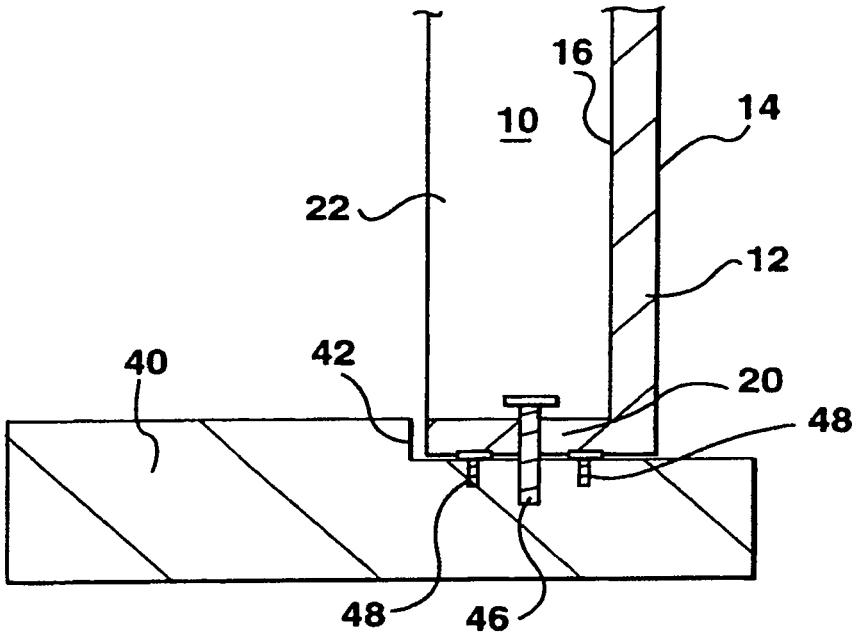
FIGS. 5 and 6 are cross sections of connections between panels and footings.
Figure 6:
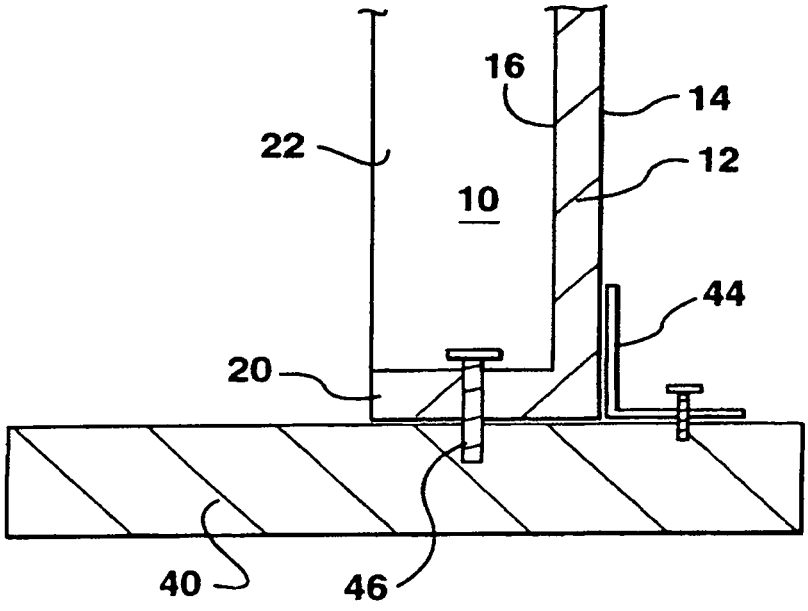

The first panel 10 typically rests on a footing 40. FIGS. 5 and 6 show typical connections between a first panel 10 and a footing 40. In FIG. 5, a step 42 is provided in the footing 40 to help locate the first panel 10 relative to the footing 40. In FIG. 5, a section of angle iron 44 is bolted to the foundation 40 for the same purpose. In both cases, foundation bolts 46 run through vertical holes 38 of the bottom beam 20 and are threaded, grouted or epoxied into the foundation 40. Optionally, the footing 40 may be provided pairs of levelling buttons 48, typically two pairs per panel, which project from the footing 40. The upper surface of the levelling buttons 48 is set at a selected elevation by screwing the levelling buttons 48 into or out of nuts cast into or attached onto the foundation 40. The upper surface of the levelling buttons 48 helps ensure that each first panel 10 is installed horizontally and that adjacent first panels 10 are at the same elevation despite an uneven foundation 40. The levelling buttons 48 also prevent an excess of mortar between the foundation 40 and the first panel 10 from being squeezed out of that joint.

Figure 7:
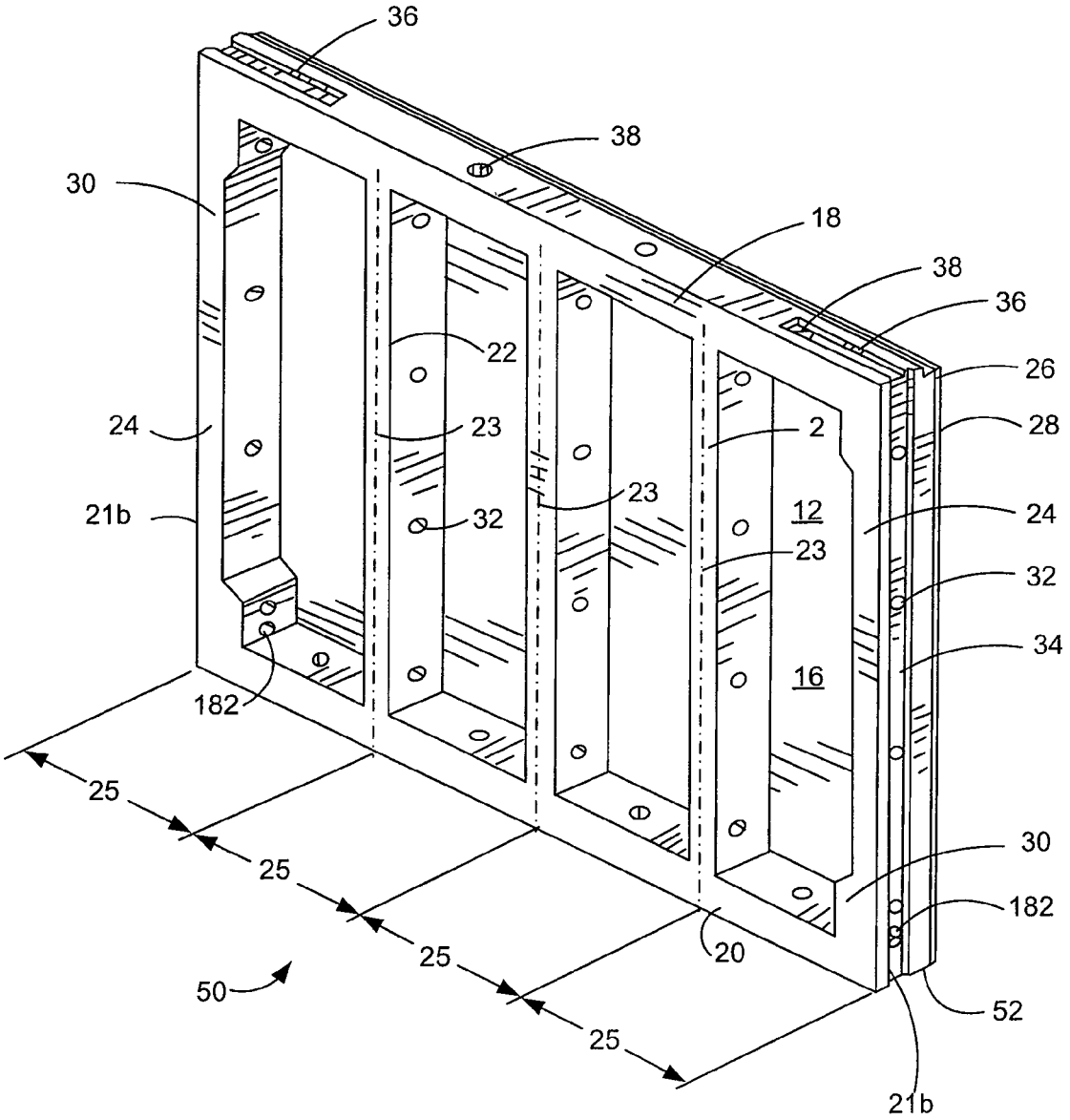
FIG. 7 is a perspective view of a second panel.

FIG. 7 shows a second panel 50 which is particularly useful for constructing above grade walls. The second panel 50 is similar to the first panel 10. The description and reference numerals used for the first panel 10 apply to the second panel 50 except as will be described below. Further, parts of the description of the first panel 10 which implicitly do not relate to an above grade panel, such as the attachment of the first panel 10 to a foundation, do not apply to the second panel 50.

Figure 18:
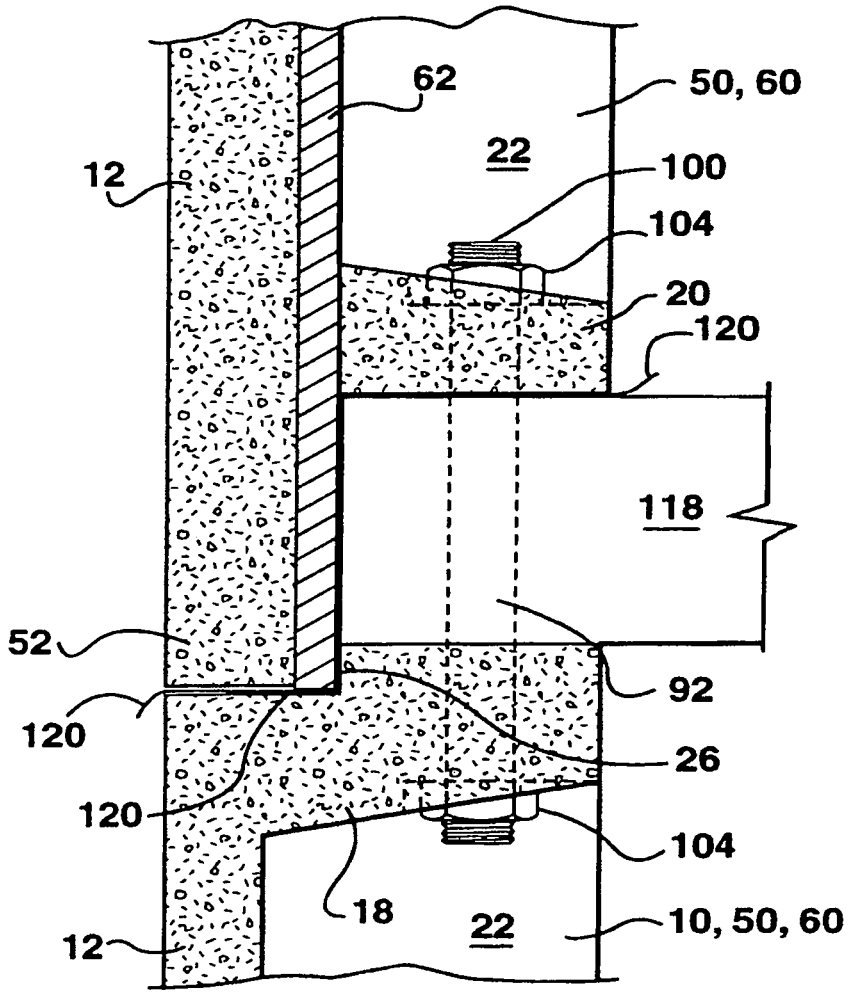
FIG. 18 is a cross section of a bolted vertical connection between panels and a floor deck.

In general, the second panel 50 may be sized and reinforced unlike the first panel 10 as required by the loading on an above grade wall as compared to a basement wall. The bottom beam 20 may be made wider than required for strength, however, to distribute the weight of the second panel 50 particularly when a second panel 50 will be installed on a wood floor deck. The second panel 50 also has an extension 52 which protrudes from the lower surface of the bottom beam 20 extending the outside face 14 of the second panel 50 downwards. This extension 52 is sized to fit into the major rabbet 26 of a lower first panel 10 or second panel 50. Where a floor deck is mounted on the lower first panel 10 or second panel 50, the extension 52 is longer than shown in FIG. 7 as required as shown in FIG. 18.

Figure 8:
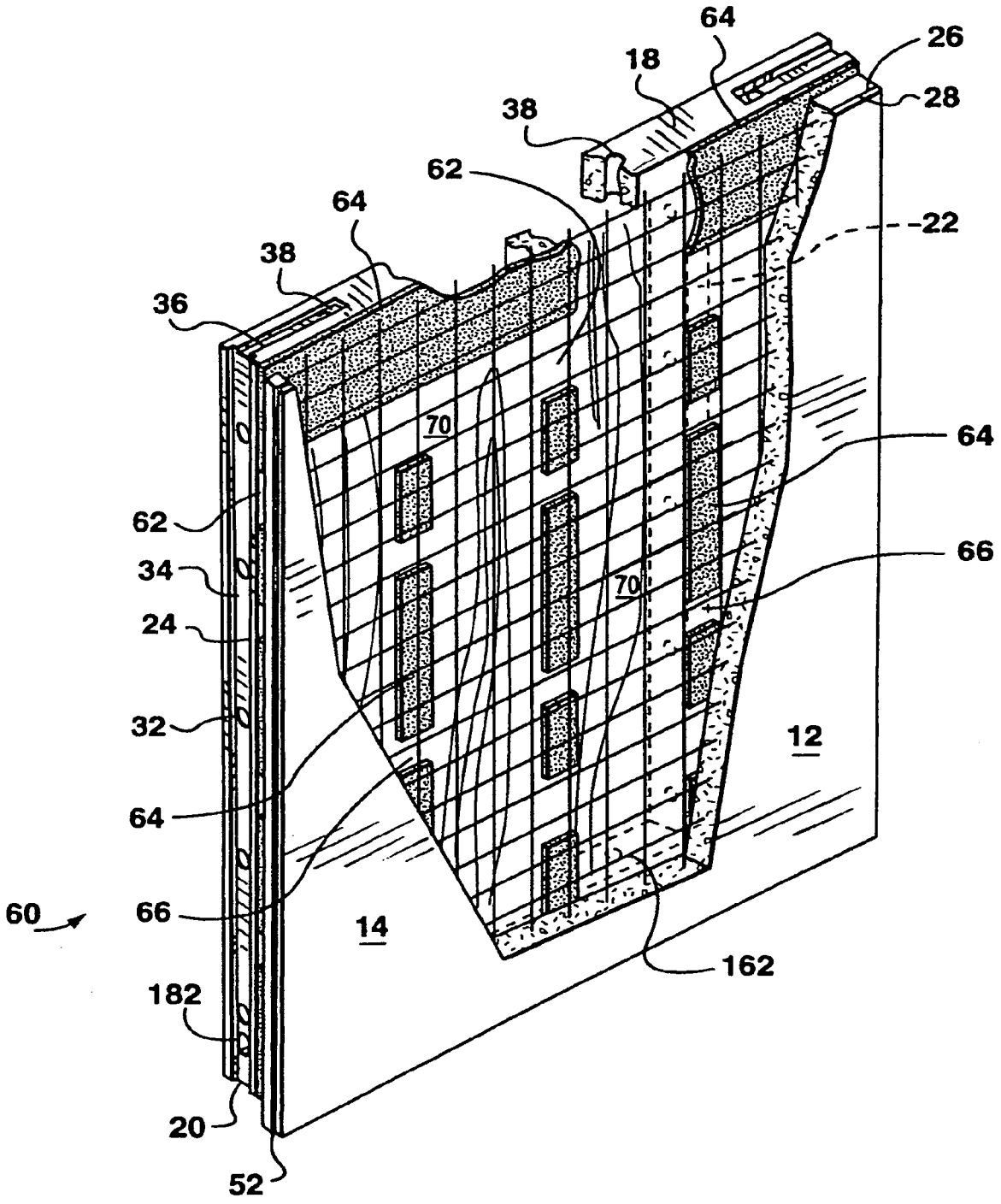
FIGS. 8 and 9 are perspective and partial cross sectional views respectively of a third panel.
Figure 9:
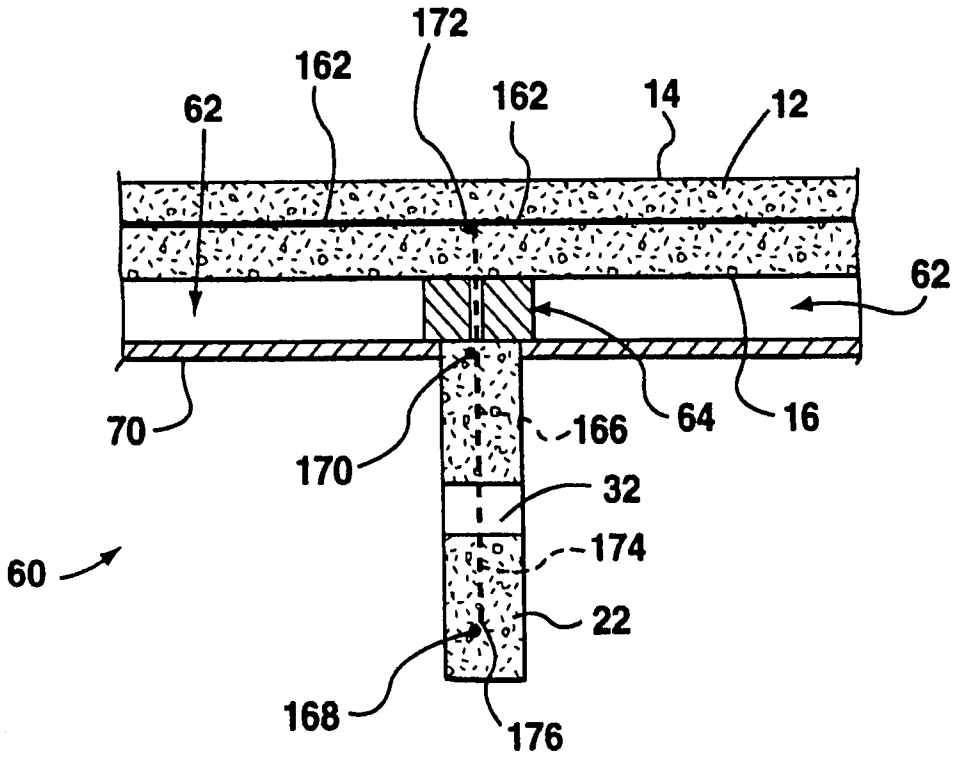

FIGS. 8 and 9 show a third panel 60 which is also particularly useful for constructing above grade walls. The third panel 60 is similar to the first panel 10 and second panel 50 and the description and reference numerals above applies generally to the third panel 60 except as will be described below. As for the second panel 50, parts of the description of the first panel 10 which do not relate to an above grade panel do not apply to the third panel 60.

The third panel 60 has an air gap 62 between the slab 12 and the beams 18, 20 and ribs 22, 24. The air gap 62 acts as a thermal break, a capillary break and as a channel to allow water or water vapour to flow out of the wall. The beams 18, 20 and ribs 22, 24 are spaced from the slab 12 by insulating blocks 64 which are arranged or drilled to provide passages across ribs 22, 24 (including ribs of adjacent third panels 60) and, in some applications, across beams 18, 20 (not illustrated). A preferred material for the insulating blocks 64 is a composite of polyethylene and cellulose or wood flour which is non-rusting, insulating and strong in compression such as POLYBOARD™, sold by Renew Resources of Toronto, Ontario, Canada.

The beams 18, 20 and ribs 22, 24 are connected to the slab 12 by metal reinforcement which will be described further below. The insulating blocks 64 preferably surround any metal reinforcement crossing the air gap 62 to inhibit condensation and rusting. Optionally, reinforcement that crosses the air gap 62 can be treated to prevent rusting, for example, by coating it with epoxy. Inner sheets 70, typically plywood or oriented strand board, extend between adjacent insulating blocks 64. The inner sheets 70 keep insulation placed between ribs 22, 24 out of the air gap 62 and may also support vapour or water barriers as required. The structure of the third panel 60 thus resembles many of the feature of a conventional stud wall with masonry facing.

Like the second panel 50, the third panel 60 has an extension 52 which protrudes from the lower surface of the bottom beam 20 and extends the outside face 14 of the third panel 60 downwards. The extension 52 of the third panel 60 is similarly sized to fit into the major rabbet 26 of a lower first panel 10 or second panel 50 but the extension 52 is not as thick as a major rabbet 26 so that the air gap 62 will be in fluid communication with a major rabbet 26.

The description of the panels 10, 50, 60 above relates primarily to standard sized panels. Since most buildings are not sized as even multiples of the width of standard panels 10, 50, 60, custom panels are made as required by making suitable modifications to the description above. Similarly, modified panels are made for corners. The following description applies to corners made of any of the panels 10, 50, 60 discussed above.

Figure 10:
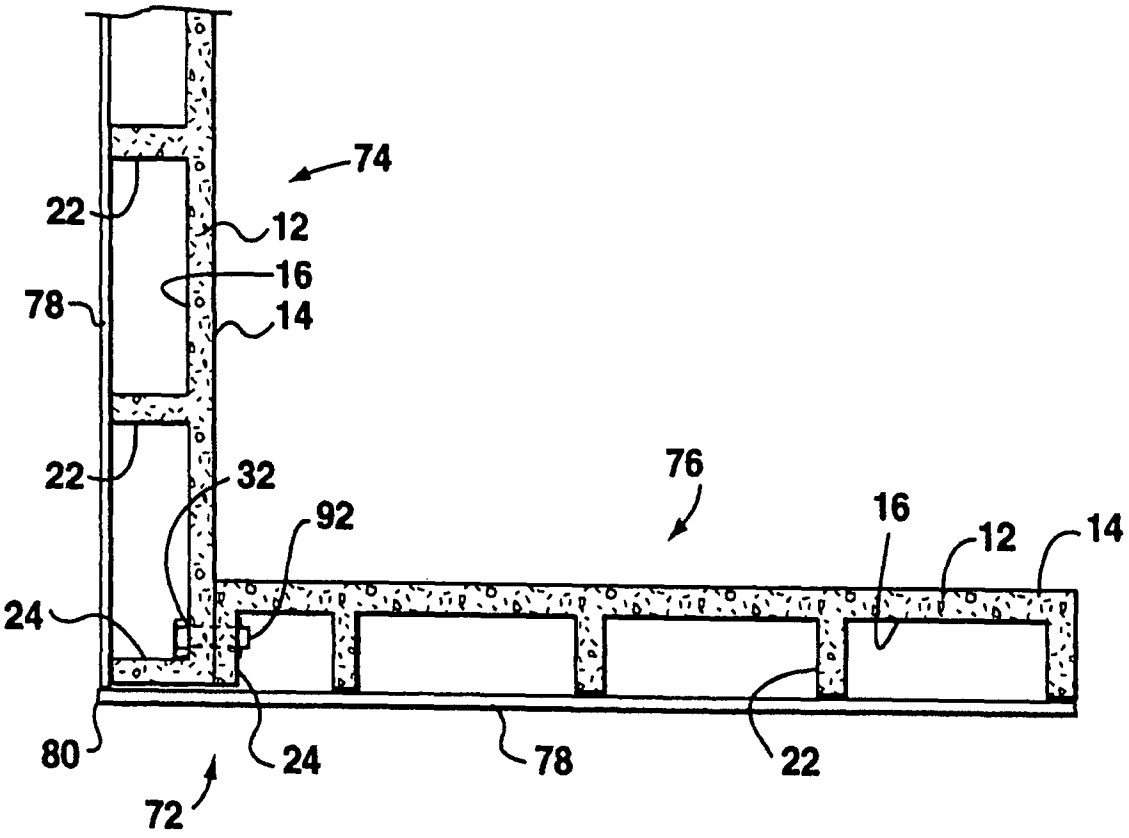
FIGS. 10 and 11 are cross sections of corner connections between panels.

FIG. 10 shows a first corner 72 between first and second corner panels 74, 76. The first corner panel 74 has additional horizontal holes 32 in its slab 12 which correspond with horizontal holes 32 in the end rib 24 of second corner panel 76. This permits pipe bolts 92 (to be discussed further below) to connect the corner panels 74, 76. To accommodate attaching whole sheet materials such as drywall 78 to the second corner panel 76, the spacing between its end rib 24 and the interior rib 22 closest to the end rib 24 is decreased. The decreased spacing is selected so that the distance between the centre of that closest interior rib 22 and the apex 80 of the first corner 72 is equal to an even fraction of the width of common sheet materials.

Figure 11:
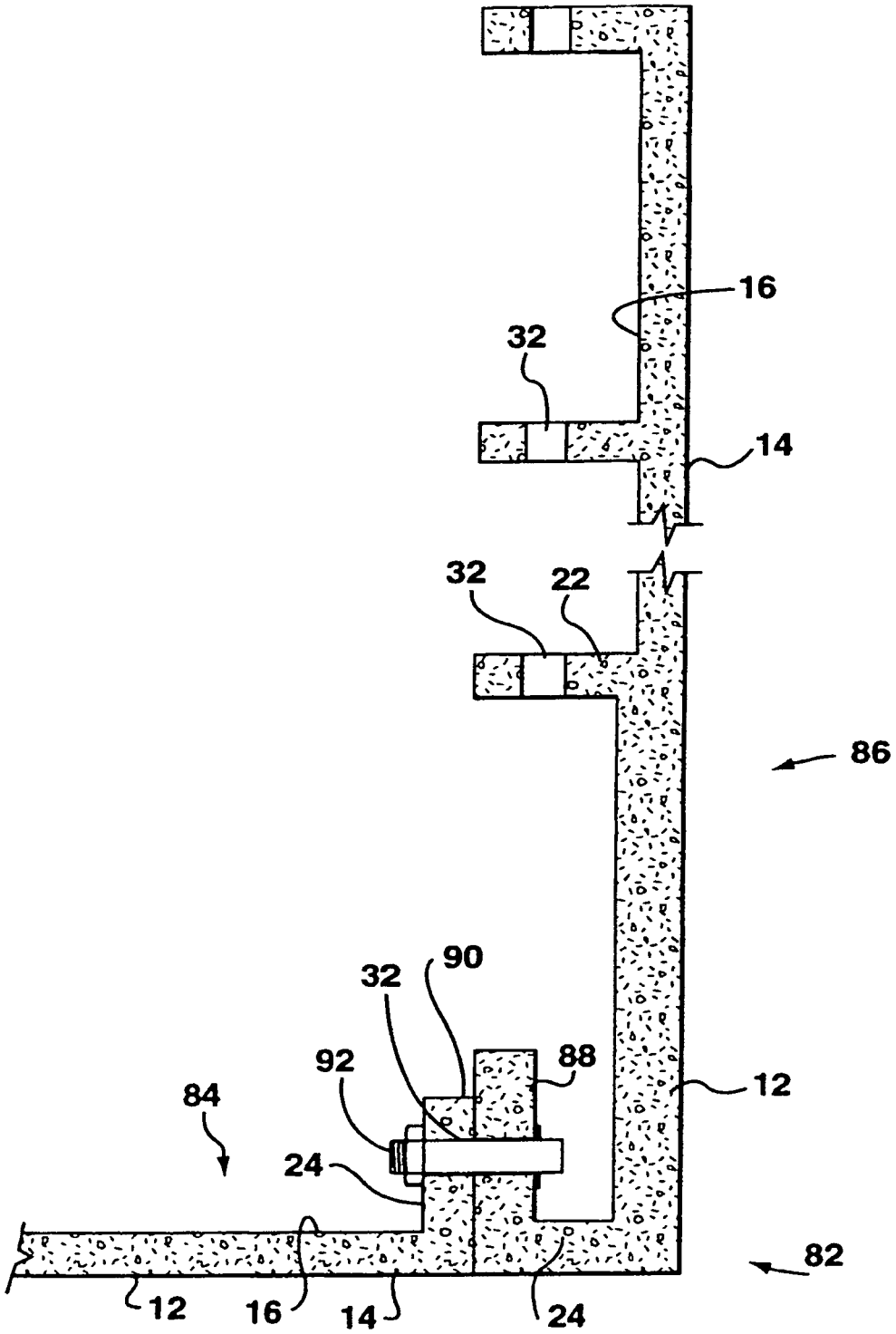

FIG. 11 shows a second corner 82 between third and fourth corner panels 84, 86. The third corner panel 84 is substantially unmodified from the description of panels 10, 50, 60 above. The fourth corner panel has a return 88 extending from an end rib 24. The return 88 has horizontal holes 32 which permits pipe bolts 92 to connect the corner panels 84, 86. To accommodate attaching un-cut sheet materials such as drywall 78 to the fourth corner panel 86, the spacing between its end rib 24 and the interior rib 22 closest to the end rib 24 is increased. The increased spacing is selected so that the distance between the centre of that closest interior rib 22 and the interior apex 90 of the second corner 82 is generally equal to an even fraction of the width of common sheet materials. The return 88 extends beyond the end rib 24 of the third corner panel 84 by an inch or two to support the edge of drywall 78 attached to the fourth corner panel 86.

Connections Between Concrete Panels and Other Building Elements

Figure 12:
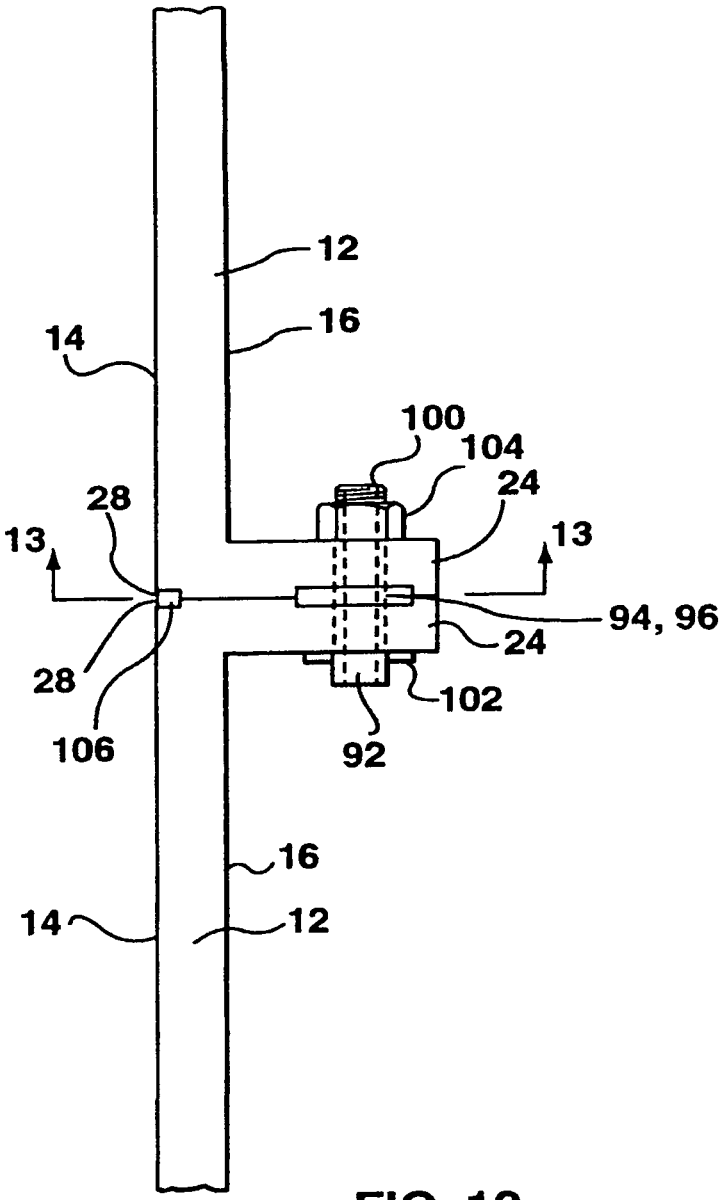
FIG. 12 is a plan view of a bolted connection between panels.
Figure 13:
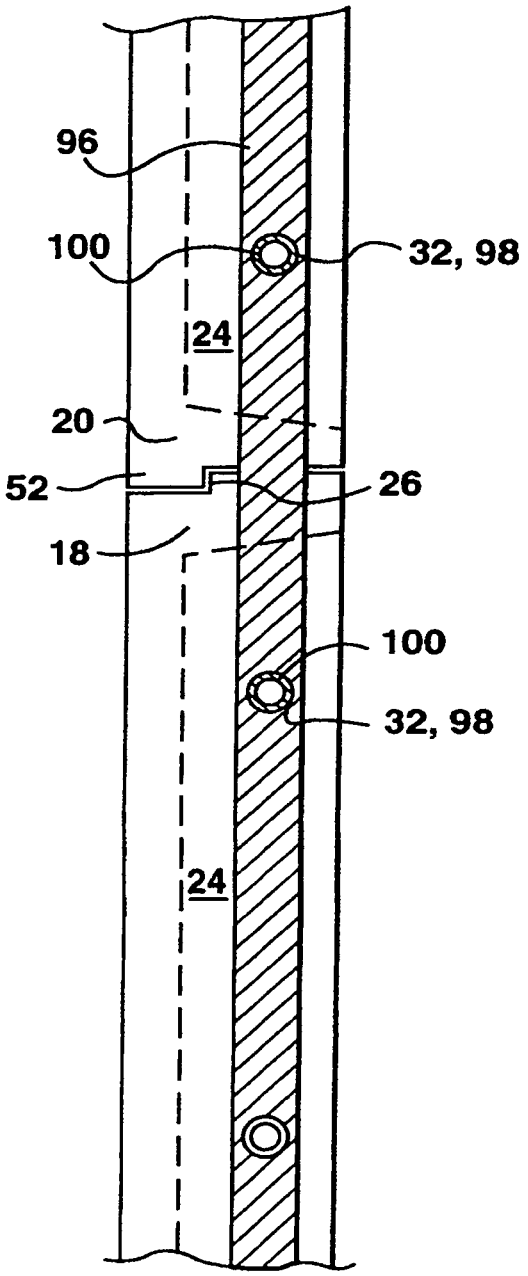
FIG. 13 is a cross section of a vertical plated connection between panels.

FIGS. 12 and 13 show connection between adjacent panels 10, 50, 60. When two panels 10, 50, 60 are placed side by side, their horizontal holes 32 align to create continuous passages between their end ribs 24. Their vertical channels 34 also create a slot 94 capable of receiving a plate 96, typically made of steel, having plate holes 98 spaced at the nominal spacing of the horizontal holes 32. The plate 96, typically about four inches by one half inch in section but slightly smaller than the slot 94, is inserted from above the panels 10, 50, 60 to generally fill slot 94 and hold the panels 10, 50, 60 in alignment with each other. In FIG. 13, the plate 96 also extends upwards to align and attach vertically adjacent panels 50, 60. Preferably such a plate 96 extends into each panel 10, 50, 60 by at least four feet. As shown in FIG. 12, caulking 106 seals the space left by the minor rabbets 28.

The connection is completed by inserting pipe bolts 92 through the horizontal holes 32 and plate holes 98 and tightening them. Typically, a pipe bolt 92 is fastened through each horizontal hole 32 of adjacent end ribs 24 and optionally through each vertical hole 38 of vertically adjacent beams 18, 20 (not illustrated). The pipe bolts 92 consist of a section of hollow pipe 100, typically steel, of about two inches in outside diameter. The horizontal holes 32 are preferably slightly larger in diameter (ie. by about one eight of an inch) than the pipe 100 to permit a small amount of adjustment between panels 10, 50, 60 or to compensate for slight misalignment of the panels 10, 50, 60.

The pipe 100 is drilled to receive a pin 102 at one end and threaded on its other end to receive a nut 104. Alternatively, the pipe 100 may be threaded on both ends and have two nuts 104. In either event, tightening at least one nut 104 draws adjacent panels 10, 50, 60 together. Because the pipes 100 are hollow, however, wire or conduits can still be passed through horizontal holes 32 or vertical holes 38. The pipe 100 also presents more surface area in contact with the end ribs 24 than would a typical bolt and thus reduces the possibility the a force applied between the pipe 100 and an end rib 24 or beam 18, 20 crushes the concrete around a hole 32, 38.

Figure 14:
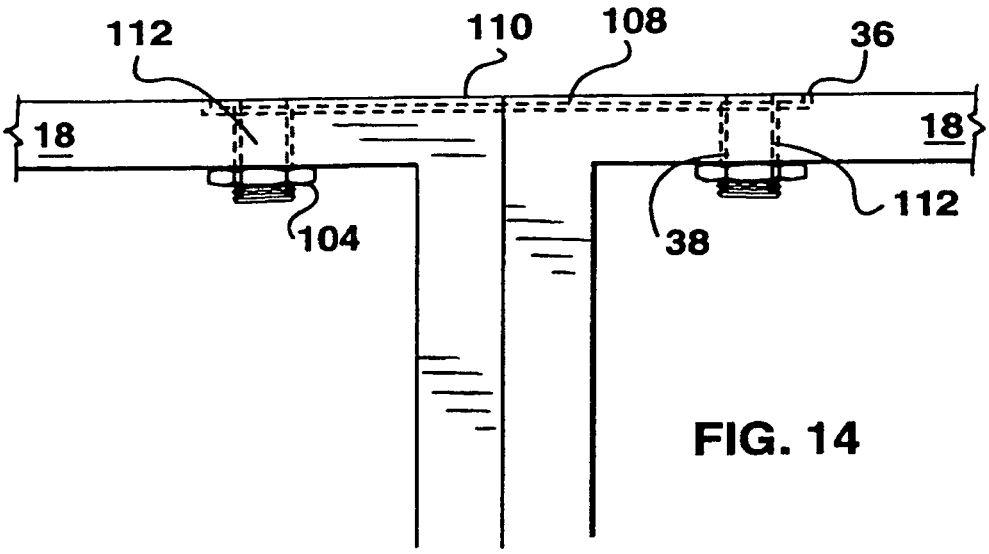
FIGS. 14, 15 and 16 are an elevational view of a stitched connection, an elevational view of a stitch and a plan view of a stitched connection respectively.
Figure 15:
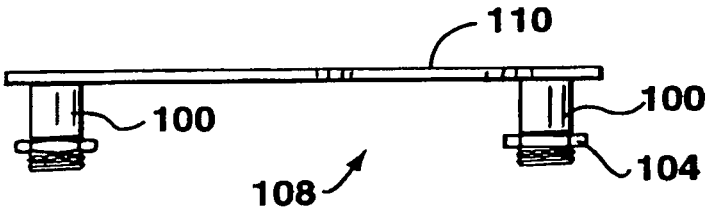
Figure 16:
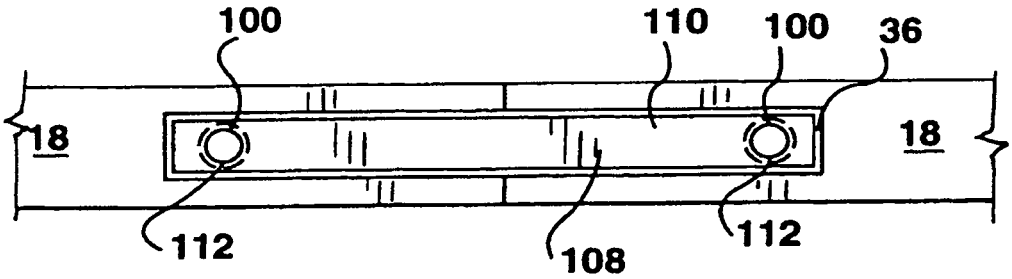

In addition to or in place of the plate 96, a stitch 108 can be used to attach horizontally adjacent panels 10, 50, 60. As shown in FIGS. 14, 15 and 16, the stitch 108 has an upper member 110, typically plate steel, and two extending legs 112, typically made of the same hollow threaded pipe of the pipe bolts 92. The legs 112 may be welded, bolted or threaded to the upper member 110. The upper member 110 may close the opening in the legs 112 or be holed so that wires or conduits can pass through the stitch 108.

The upper member 110 of the stitch 108 fits into the horizontal channels 36 of adjacent panels 10, 50, 60. The legs 112 extend through vertical holes 38 in the beams 18, 20. Stitch nuts 114 are then threaded onto the legs 112 and tightened. Depending on the application, stitches 108 may be used on the bottom beams 20, top beams 18 or both of adjacent panels 10, 50, 60.

When a stitch 108 is used without a plate 96, the stitch 108 performs the function of keeping panels 10, 50, 60 aligned while pipe bolts 92 are being fastened. This allows, as an alternative to the arrangement shown in FIG. 13, the vertical seems between plates 10, 50, 60 of one floor of a building to be staggered relative to the vertical seems between plates 10, 50, 60 of a vertically adjacent floor. When a stitch 108 is used with a plate 96, a slot is made in the plate 96 to accommodate the stitch 108. The slot is made of sufficient size and shape to allow one side of the stitch 108 (and its leg 112) to pass through the slot and to allow the stitch 108 to move upwards or downwards as required to slide the legs 112 into vertical holes 38. Alternatively or additionally, a connection between four panels 10, 50, 60 can be made by placing a stitch 108 with longer legs 112 on top of the bottom beam 20 of two horizontally adjacent panels 50, 60. The legs 112 pass through vertical holes 38 of the two horizontally adjacent panels 50, 60 and though the vertical holes 38 of another two horizontally adjacent panels 10, 50, 60 located directly below the first two horizontally adjacent panels 50, 60. A stitch access hole 182 (as shown in FIG. 7 for example) is provided in the sides of end ribs 24 just above the tops of bottom beams 20 to accommodate such a stitch 108 passing between two horizontally adjacent panels 10, 50, 60.

Figure 17:
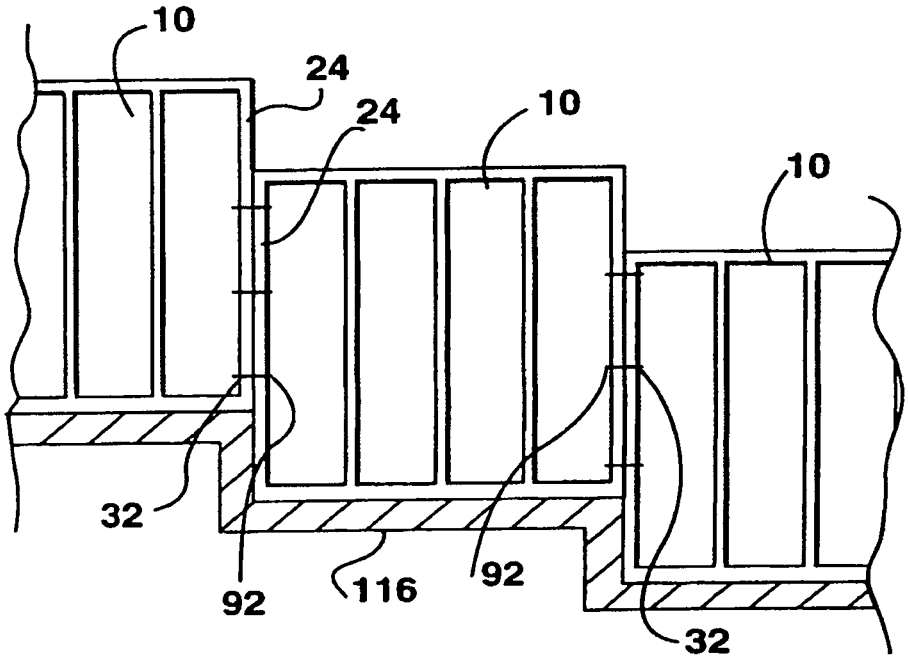
FIG. 17 is an elevation of first panels installed on a stepped foundation.

FIG. 17 shows a series of first panels 10 descending down a stepped footing 116. The steps in the stepped footing are made as high as the nominal spacing of the horizontal holes 32. In this way, pipe bolts 92 may be used to attach adjacent first panels 10 together. The upper surface of the first panels 10 can be levelled by placing short first or second panels 50, 60 on top of them or by using a series of first panels 10 of increasing height.

FIG. 18 shows an alternative connection between vertically adjacent panels 10, 50, 60 using pipe bolts 92 instead of plates 96. In addition, a conventional floor deck 118 is inserted between a lower panel 10, 50, 60 and an upper panel 50, 60. Plastic sheet 120 extends from outside the major rabbet 26 of the lower panel 10, 50, 60, upwards along the end of the floor deck 118 and along the top of the floor deck 118 to the interior of the wall. Where utilities do not need to pass between vertically adjacent panels 10, 50, 60, the pipe bolts 92 may be replaced with regular bolts.

The connections of FIGS. 13 and 18 may be combined. In either of the vertical connections of FIG. 13 or 18, the lower edge of the extension 52 of the upper panels 10, 50, 60 has drainage holes, preferably on about four foot centres. The drainage holes are typically about ¼ inch in diameter and permit water trapped in the joint between vertically adjacent panels 10, 50, 60 or running down through an air gap 62 to leave the wall. The plastic sheet 120 of FIG. 18 is typically also used in the connection of FIG. 13.

Figure 19:
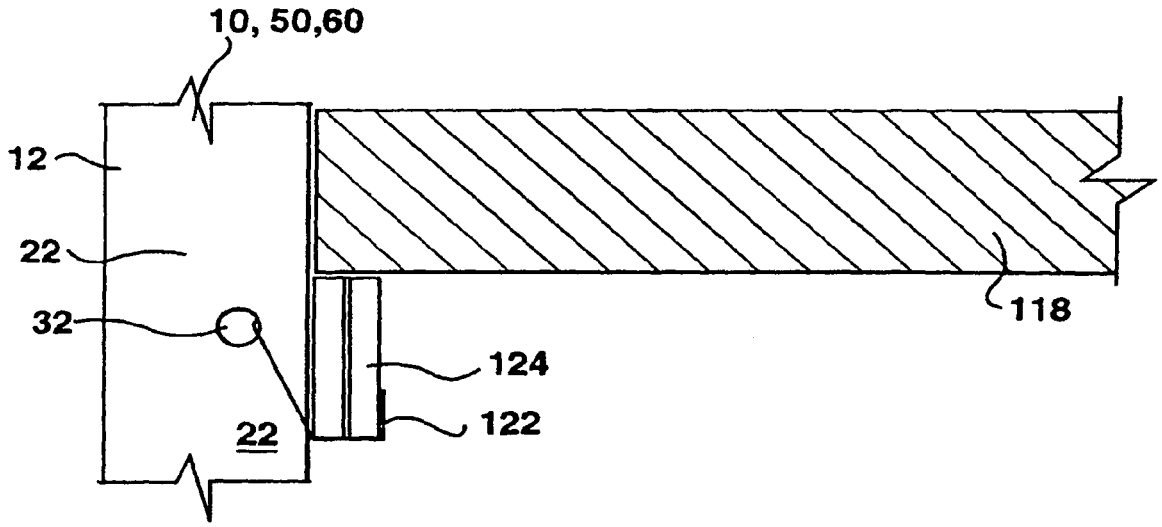
FIGS. 19 and 20 are connections between a floor deck and panels utilizing horizontal holes in the panels.
Figure 20:
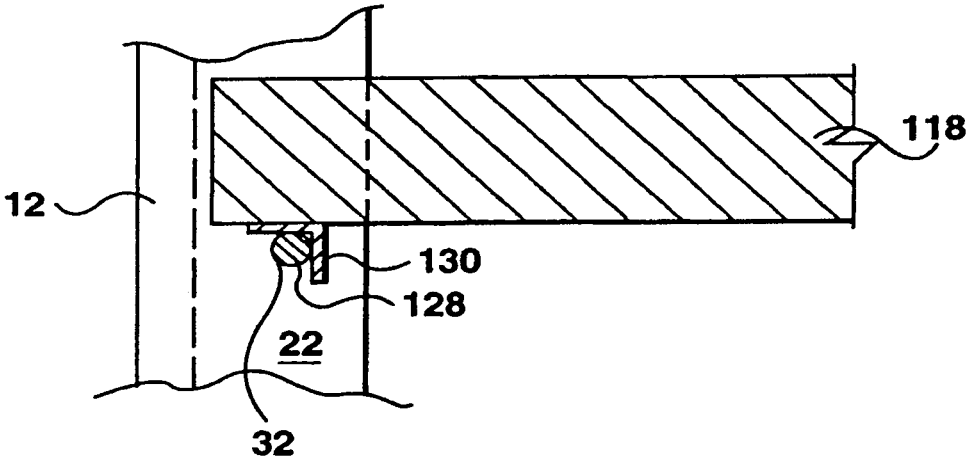

FIGS. 19 and 20 show two other methods by which a conventional floor deck 118 is supported by panels 10, 50, 60. In FIG. 19, hangers 122 are bent from strips of steel plate typically about one and one half inches wide. First ends of each hanger 122 are hooked into a series of horizontal holes 32 at a common elevation. Second ends of hangers 122 are bent to form supports for a beam 124. Joists 126 are toe-nailed to the tops of the beams 124 or supported by joist hangers nailed to the beams 124. In FIG. 20, an elongated pipe 128, similar in cross section and material to the pipe 100 of a pipe bolt 92, is placed through several horizontal holes 32 at a common elevation. An abutment 130, typically a length of angle iron, is attached to the elongated pipe 128. A floor deck 118 can then be attached to the upper surface of the abutment 130.

Figure 29:
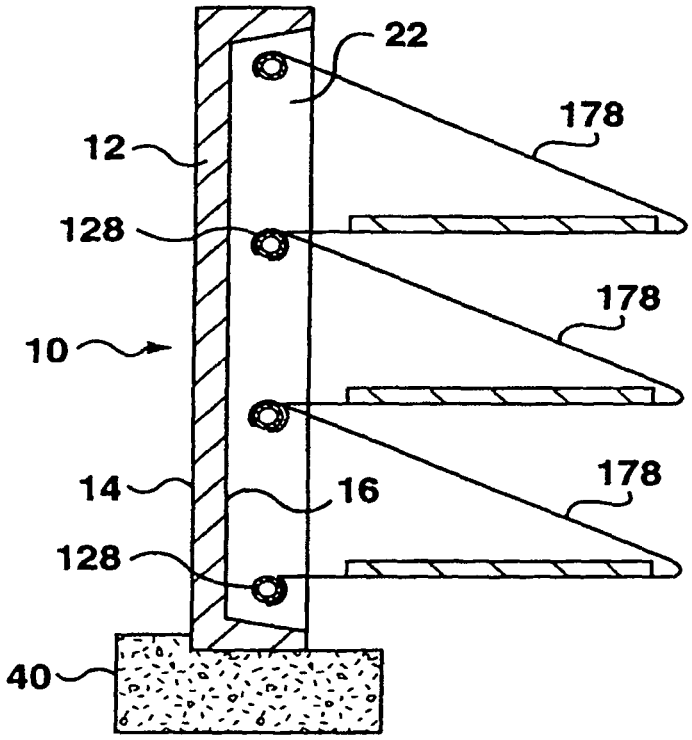
FIG. 29 is a schematic representation of a first panel used as a retaining wall.

FIG. 29 shows how the elongated pipes 128 can be used to install a first panel as a retaining wall. Brackets 178 are suspended from the elongated pipes 128 and extend behind the first panel 10. The brackets 178 support shelves 180 which span multiple brackets 178 of the same elevation. When earth or fill is backfilled against the inside face 16 of the first panel 10, the earth or fill is also piled on top of the shelves 180, starting from the lowest shelf 180. The weight of the earth or fill on the shelves 180 allows the first panel 10 to remain generally vertical after it is backfilled completely. A second panel 50 also fitted with brackets 178 and shelves 180 can be attached on top of the first panel 10 to build a retaining wall of greater height.

Methods of Making Concrete Panels and Their Interior Structure

Figure 22:
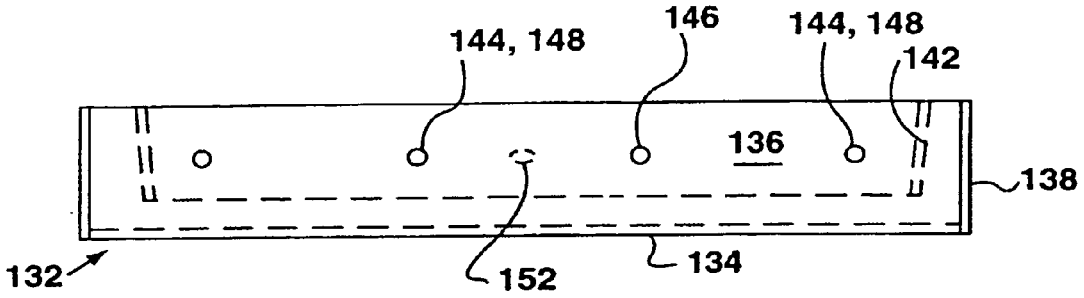
FIGS. 21 and 22 are elevation and plan views respectively of a form for making panels.
Figure 21:
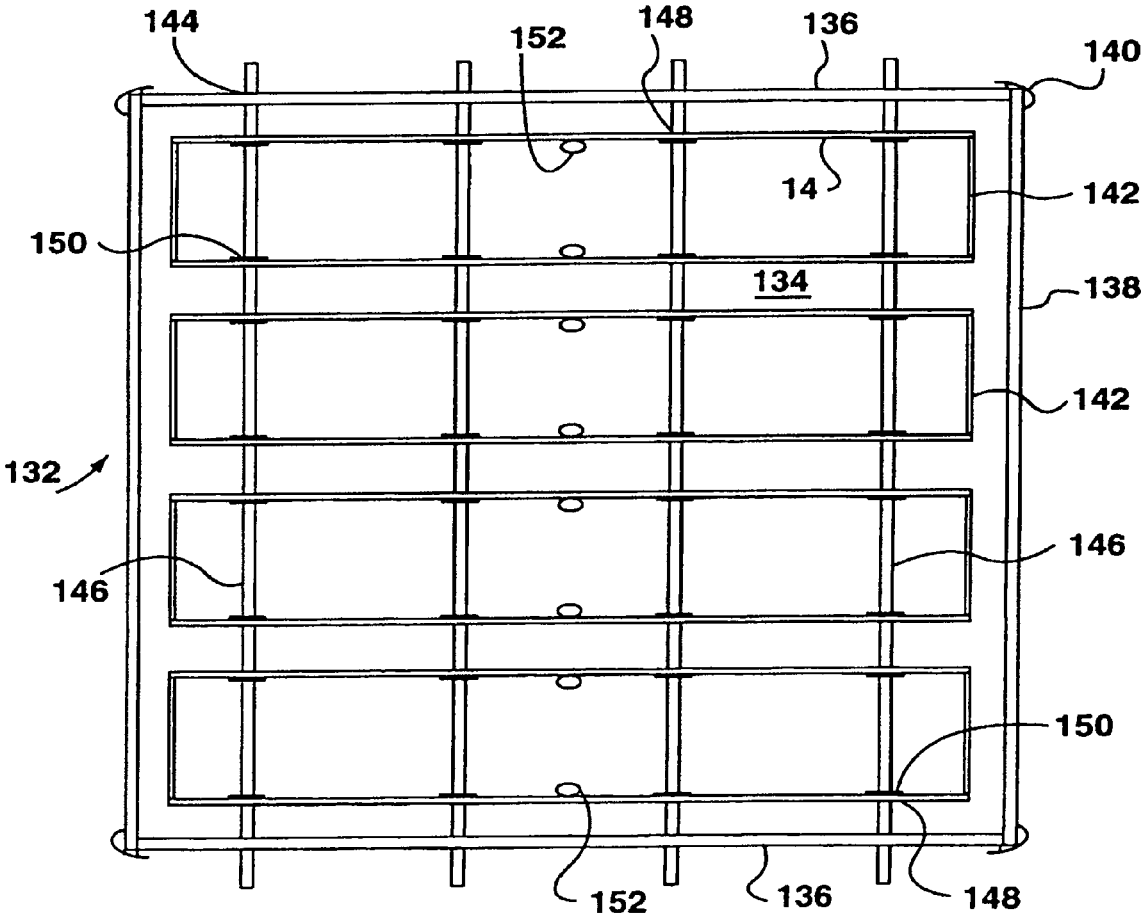

FIGS. 21 and 22 show a simplified form 132 for making first and second panels 10, 50. Various elements of the form 132, such as those needed to form major rabbets 26, minor rabbets 28, widened portions 30 or extensions 52, are not shown to better illustrate to following points.

The perimeter of the form 132 consists of a base 134, first sides 136 and second sides 138. For small runs, the base 134 and sides 136, 138 are preferably made of wood and nailed together with double headed nails for easier form stripping after a panel 10, 50 is made. For production runs, the base 134 and sides 136, 138 are preferably made of steel and attached with releasable clips 140. A plurality of sub-forms 142 define the interior edges of the beams 18, 20 and ribs 22, 24. The sub-forms 142 are bottomless, however, and do not form the inside face 16 of the slab 12.

The first sides 136 are provided with side holes 144 spaced relative to the ribs 22, 24 so as to be concentric with the horizontal holes 32. A rod 146, typically a hollow steel pipe, has an outside diameter substantially equal to the diameter of the horizontal holes 32. The sub-forms 142 have sub form holes 148 which receive the rods 146 when the sub-forms 142 are in their proper position relative to the form 132. The rod 146 passes through the side holes 144 and sub-form holes 148 and extends across the form 132. Clamps 150 secure the sub-forms 142 in place laterally.

The sub-forms 142 are placed in the form 132 and the rods 146 are slid in place. The rods 146 act as a jig to quickly locate and hold the sub forms 142 in their proper place. Clamps 150 are secured. A layer of concrete to make the slab 12 is placed in the bottom of the form 132 (it can be poured through the sub-forms 142) and allowed to set somewhat so that it will not be substantially dislocated by later steps. More concrete is added to the form 132 to fill the spaces around the sub-forms 142. When the form 132 is filled, the concrete may vibrated as required and its exposed surface finished. Some special features, such as the return 88 shown in FIG. 11 may be formed after the remainder of a panel 10, 50 is complete.

The arrangement of the form 132 described above allows a textured base 134 to be used which applies an architectural finish to the outside face 14 of the slab 12. Alternatively, the sub-forms 142 can be inverted and positioned to contact the base 134. In this orientation, the outside face 14 of the slab 12 faces upwards and is exposed during forming. Such an exposed outside face 14 can be finished, for example, by texturing it or casting half bricks or tiles into it. In this orientation, the base 134 can also be made of a suitable sheet material with nails or other connectors protruding into the beams 20, 22 or ribs 22, 24. This sheet material remains a part of the panel 10, 50 after the concrete cures.

After the concrete cures, the form 132 is stripped, the components having previously been coated with release compound to make stripping easier. The rods 146 are removed by pulling them sideways out of the form 132. Because of the location and size of the rods 146, removing them automatically creates horizontal holes 32 where required. Vertical holes 38 are preferably also created during forming, for example by leaving sacrificial spacers in the form 132 as is known in the art. The sub-forms 142 have rings 152 which receive a cable from an overhead crane which pulls them out. The sub-forms 142 are preferably made of spring steel so that they flex away from the concrete when pulled to make stripping easier. The sides 136 and 138 are then separated from the base 134.

Optionally, the sub-forms 142 can be made of rigid foam insulation. In that case, the sub-forms 142 are not stripped and remain in the panel 10, 50 except as required to accommodate pipe bolts 92. Such foam sub-forms 142 are particularly useful when a return 88 (as shown in FIG. 11) will be formed in the panel 10, 50 since it allows the return 88 to be formed before the sub-forms are removed. Alternatively, an end rib 24 can be angled inwards without requiring complex collapsible forms. Such angled end ribs 24, or end ribs 24 angled outwards, provide another way of making corners in a wall. For example, two panels 10, 50 each with their end ribs 24 angled inwards by 45 degrees can be bolted together to make a 90 degree corner. This method is particularly useful however in making non-right angled corners as required, for example, for many bay windows. Further optionally, the rods 146 can be made of plastic pipes and left in the panel 10, 50 and later cut open as required.

The description above also applies to a third panel 60, but with some modifications. Before any concrete is poured or after the concrete for the slab 12 is poured, sub-forms 142 are located in the form 132 by rods 146 and clamps 150. Insulting blocks 64 are attached to the lower edges of the sides of the sub-forms 142. The insulting blocks 64 are cut or shaped as necessary to accommodate reinforcing material extending from the slab 12 of ribs 22, 24 or beams 18, 20 and provide passages 66 as discussed above. Additional material is also attached to the lower edges of the sides of the sub-forms 142 to temporarily fill the passages 66. This material will be removed later and is preferably a soft foam. Concrete for the slab 12 is then poured through the sub-forms 142 and vibrated in place. Concrete for the beams 18, 20 and ribs 22, 24 is then poured into the spaces between the sub-forms 142. After the concrete cures, the form 132 is stripped and the additional material removed. Inner sheets 70 may be added to the third panel 60 and attached to the insulating blocks 64 while the concrete is curing or after casting of the entire panel.

Figure 23:
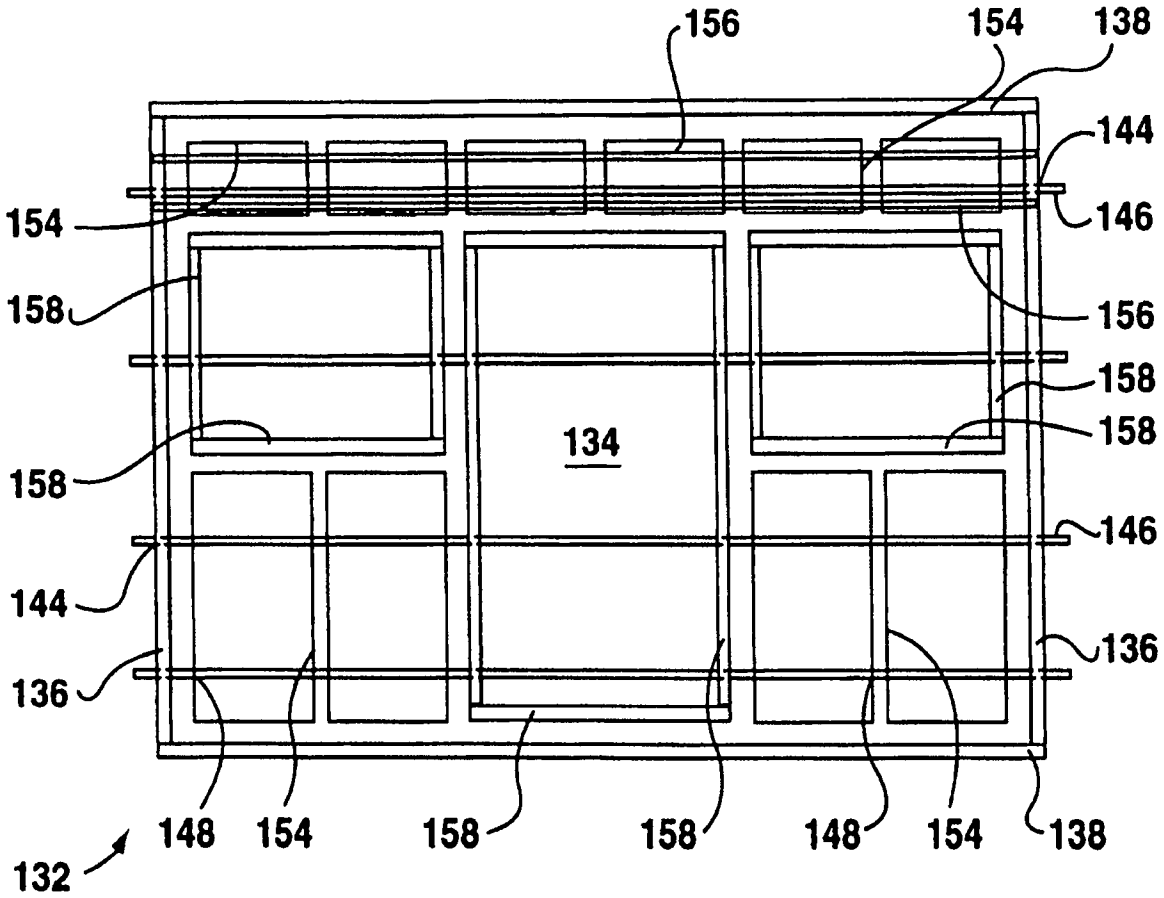
FIG. 23 is a plan view of a form for making panels with door or window openings.

FIG. 23 illustrates how the forming processes described above can be used to provide door or window openings into a panel 10, 50, 60. Modified sub-forms 154 are made to define the spaces in the panel 10, 50, 60 other than the spaces reserved for the door or window openings. Modified sub-forms 154 that will be support by only one rod 146 are kept level with strapping 156 placed across the first sides 136. Door or window bucks 158 are made to the required sizes and at a thickness that extends from the base 134 to the top of the form 132. The bucks 158 are typically made of dimensional lumber with screws or nails driven through them to protrude into the concrete of the beams 18, 20 or ribs 22, 24. Such bucks 158 remain in the panel 10, 50, 60 after it is made to provide the rough frame of a door or window. Alternatively, bucks 158 (without screws or nails driven through them) may be removed after the panel 10, 50, 60 is made.

Figure 24:
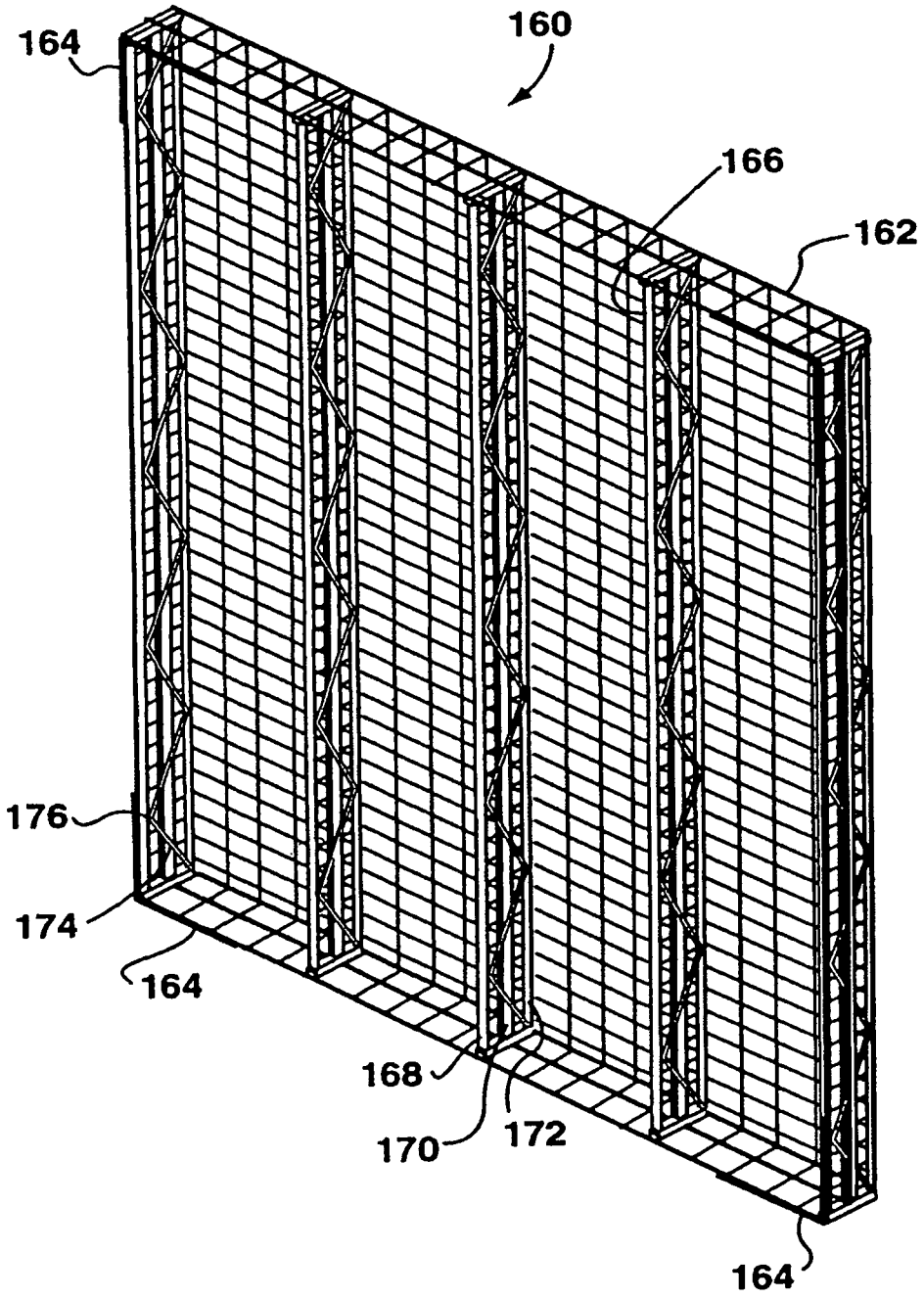
FIG. 24 is a perspective view of a basket of reinforcing material for a third panel.
Figure 28:
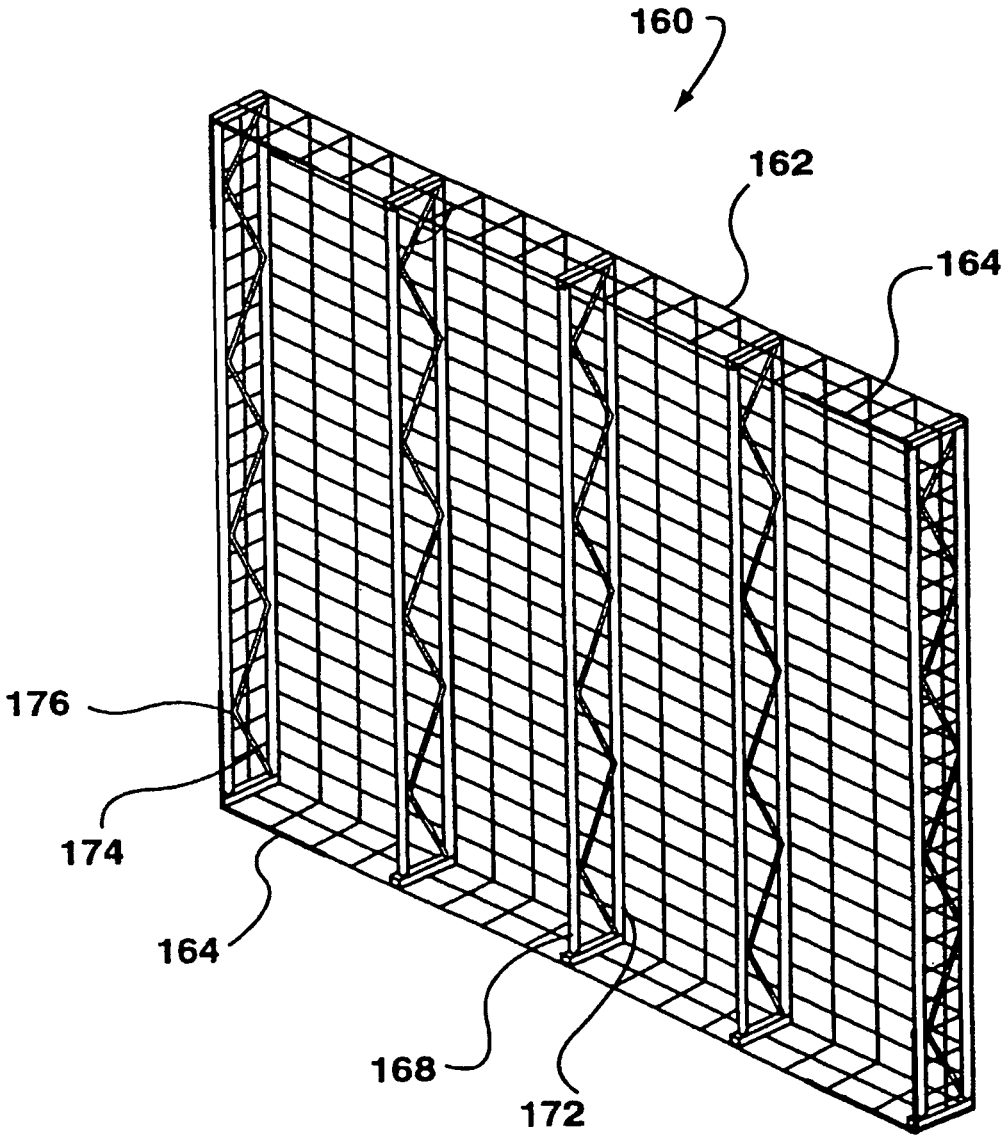
FIG. 28 is a perspective view of a basket of reinforcing material for a first or second panel.

As was mentioned above, the panels 10, 50, 60 are reinforced. Preferably, this reinforcing is pre-formed in a basket 160 as shown in FIGS. 24 and 28. FIG. 24 shows a basket 160 for an eight foot by ten foot third panel 60. FIG. 28 shows a basket for an eight foot square first or second panel 10, 50. The baskets 160 include a wire mesh 162 sized as required to reinforce the slab 12. The wire mesh 162 is bent upwards on all four sides to also provide reinforcement for the beams 18, 20 and end ribs 24. The corners of the basket 160 are reinforced by stiffening bars 164 as shown. Trusses 166 are provided to reinforce the ribs 22, 24 and located appropriately. Tie wires secure the various components of the basket 160 together. The basket is inserted into the form 132 prior to installing the sub-forms 142 or rods 146 or pouring any concrete. The basket is shimmed as required to locate is within the form 132.

Figure 25:
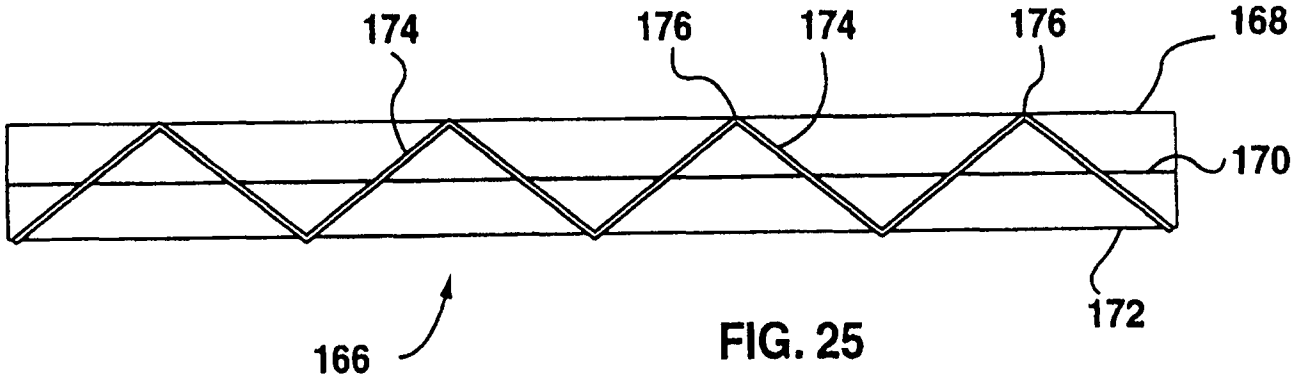
FIGS. 25, 26 and 27 are a reinforcing truss, a reinforcing truss installed in a rib of a first or second panel and a reinforcing truss installed in a rib of a third panel respectively.
Figure 27:
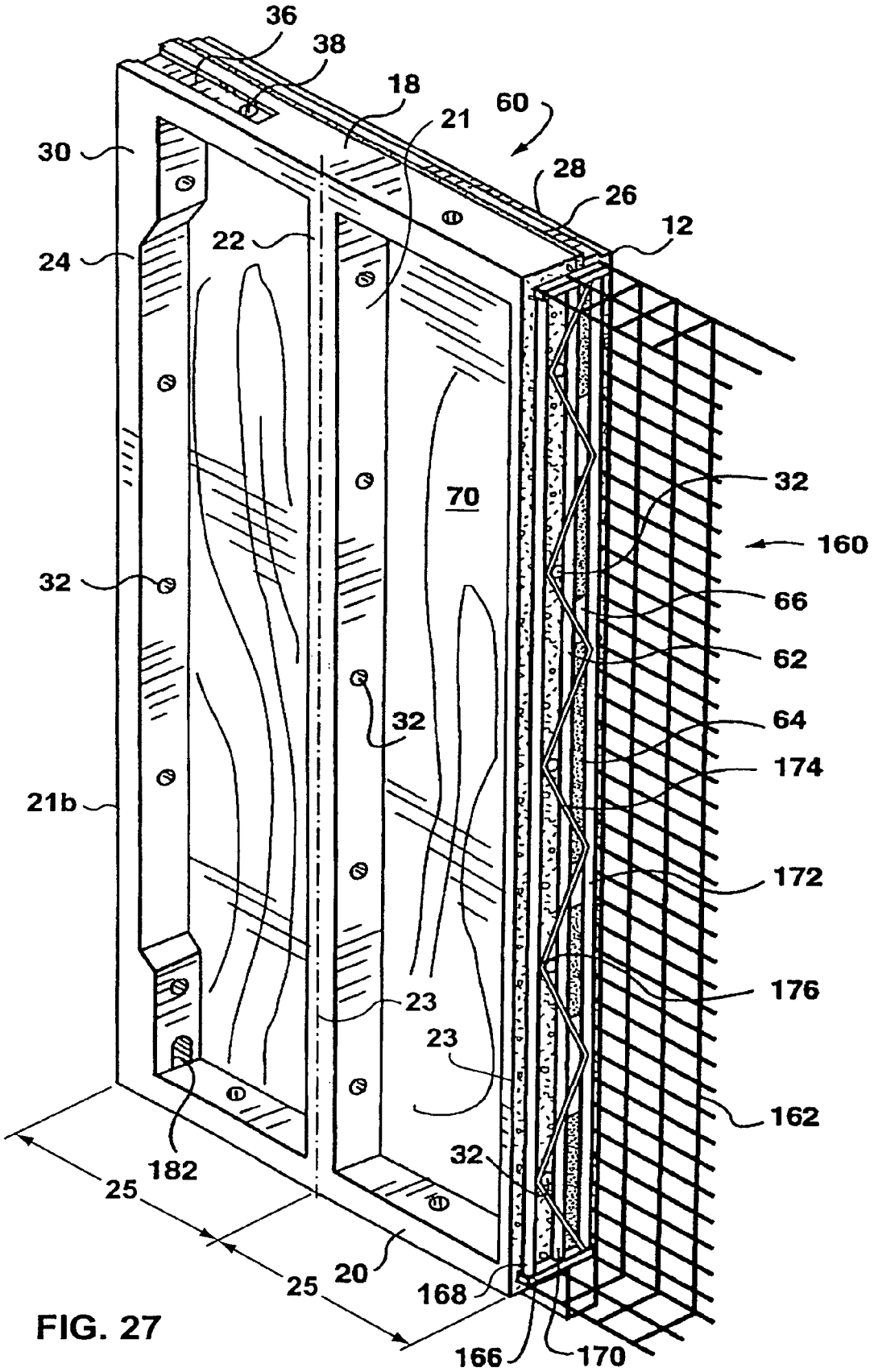

FIG. 25 shows a truss 166 for a third panel 60 in greater detail. The truss 166 has an upper cord 168, a mid cord 170 and a lower cord 172. Trusses for first and second panels 10, 50 are similar but the mid cord 170 may be omitted, as shown in FIG. 28. The lower cord 172 of the truss 166 is tied to the mesh 162 and accordingly is located in the slab 12 of a finished panel 10, 50, 60. The mid cord 170 and upper cord 168 are located in the ribs 22, 24 of a finished panel 10, 50, 60. In particular, as shown in FIGS. 9 and 27, the lower cord 168 or mid cord 170 and upper cord 172 contain the horizontal holes 32. In the third panel 60, the mid cord 170 is located outside of the air gap 62.

Figure 26:
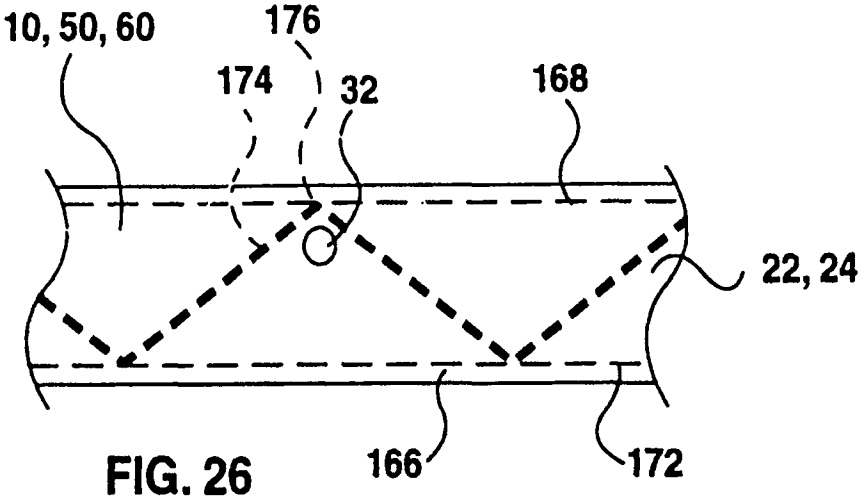

Diagonals 174 run across the cords 168, 170, 172 and are welded to them. Although the diagonals 174 may be distinct pieces, several diagonals 174 are typically made simultaneously by bending a piece of steel as required. The intersections 176 of the diagonals 174 at the upper cord 168 are spaced as described for the horizontal holes 32. Thus, as shown in FIGS. 26 and 27, the diagonals 174 further contain or surround the horizontal holes 32. This significantly reinforces the horizontal holes 32 and assists in making them strong enough to join adjacent panels 10, 50, 60 together or to support floors as shown in FIGS. 19 and 20. As shown in FIG. 27, the diagonals 174 of a third panel 60 also provide rigid, triangulated support for the slab 12 which assists in supporting the weight of the slab 12.

Additional Corner Connections

Figure 30:
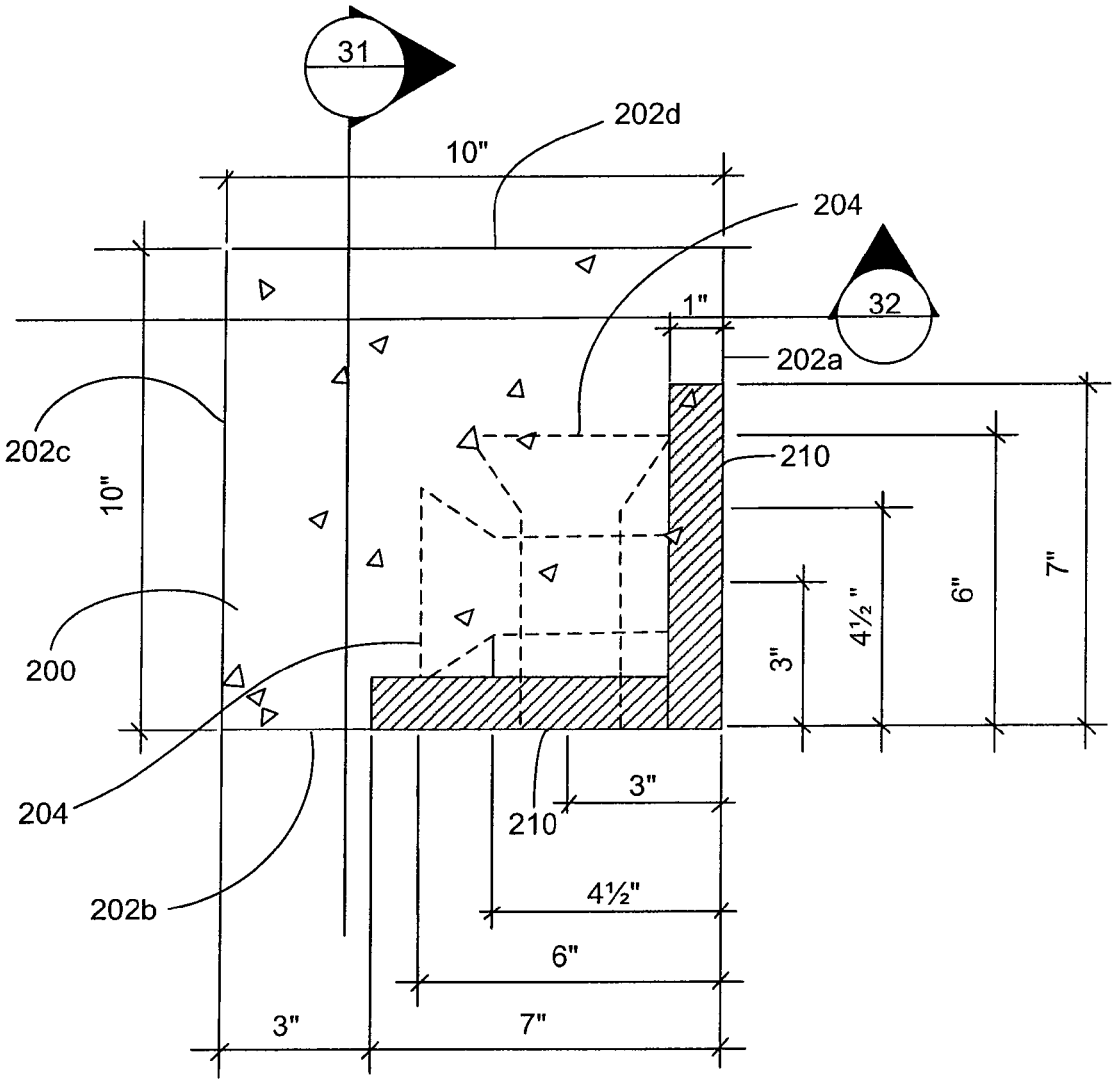
FIG. 30 shows a plan view of a column.
Figure 32:
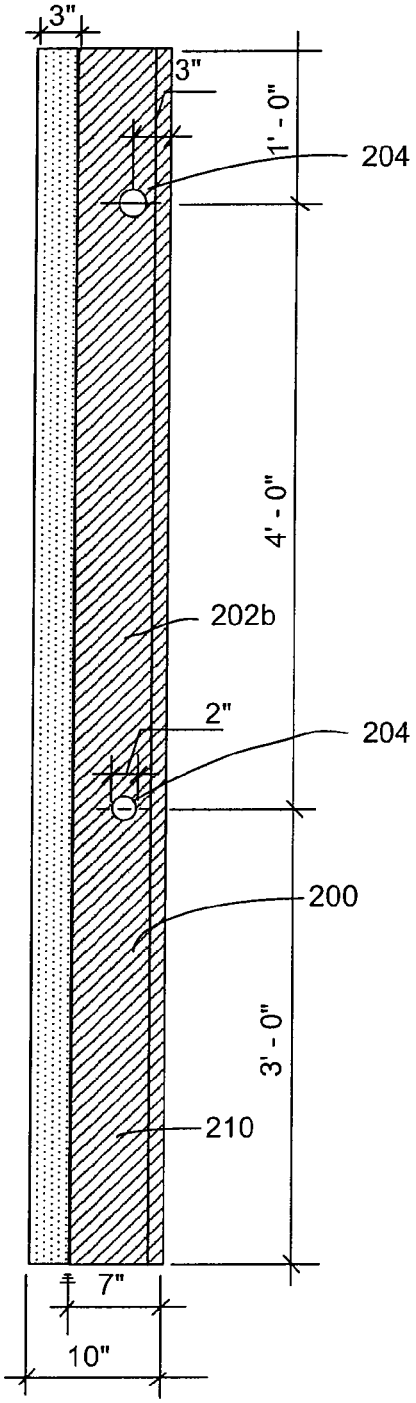
FIG. 32 shows a front elevation of the column of FIG. 30.
Figure 31:
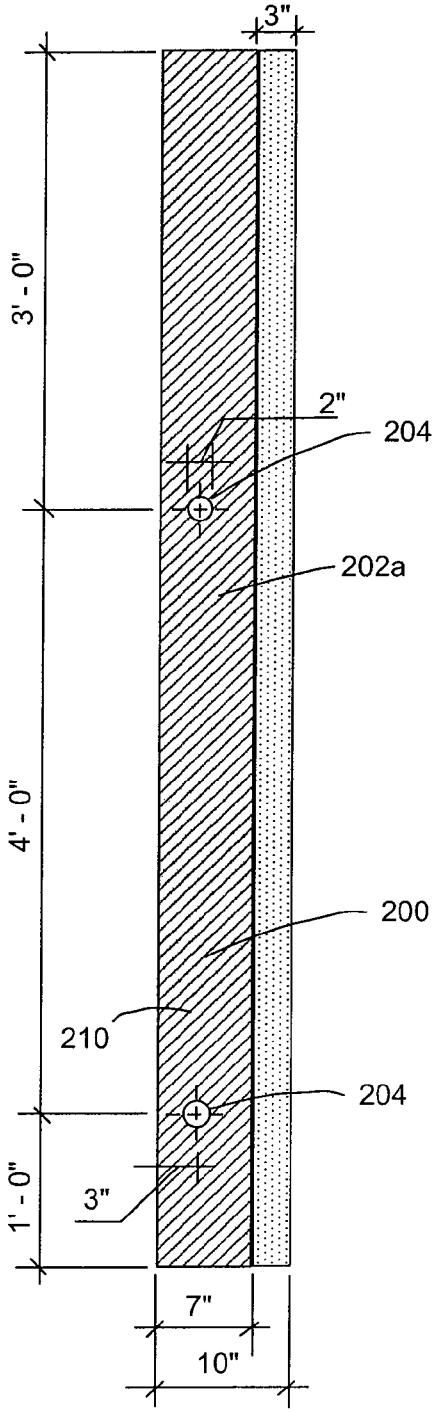
FIG. 31 shows a right side elevation of the column of FIG. 30.

FIGS. 30-32 show a column 200 that may be used to connect two panels having an end rib with holes, for example panels 10, 50, 60 described above. Column 200 may be cast in concrete, for example in a mold made of four hinged sides, each side of the size and shape of one side 202 of the column 200. The mold may rest on a floor or platform, or have a bottom attached to one of its sides to form the bottom of the column 200. The top of the column 200 is formed by scraping excess concrete from the top of the mold.

The column 200 may have threaded inserts 204 cast into it. The threaded inserts 204 may be of any number of commercially available types of inserts used to provide threaded holes in concrete castings. The insert 204 is typically a metal casting with an internally threaded bore, sometimes covered in a plastic shell. To place the insert 204 in the column, holes are made in the sides of the mold corresponding to the desired location of the inserts 204 in the column 200. The inserts 204 are then bolted to the inside of the mold. When the mold is closed and filled with concrete, the inserts 204 are held by the bolts through the form. When the concrete cures, the inserts 204 become cast in place in the column 200 in desired locations. The mold may be stripped by removing the bolts and then opening the form.

In column 200, two inserts 204 are provided in each of two faces 202*a*, 202*b* of the column 200. The height of the inserts 204 corresponds to the height of holes 32 in the end ribs 24 of the panels 10, 50, 60. Each face 202*a*, 202*b* has two inserts 204 located to correspond with alternating holes 32 such that the inserts 204 clear each other in the column 200. In column 200 as shown, the height of the inserts 204 is such that the top and bottom of the column are flush with a panel 10, 50, or with a third panel 60 not accounting for the extension 52. However, a column 200 may be made to extend above or below a panel 10, 50, 60. For example, a column 200 extending above or below a panel 10, 50, 60 may allow structures above or below the panel 10, 50, 60 to be attached to the panel 10, 50, 60. In a multistory structure, a column 200 may extend continuously between two or more stories to connect upper and lower panels 10, 50, 60 together.

The distance of the insert 204 to the outer sides 202*c*, 202*d* of the column 200 is selected to correspond with the distance from the holes 32 in the end ribs 24 to the outside face 14 of a panel 10, 50, 60. In column 200, the inserts 204 are placed so that the outer faces 202*c*, 202*d* of the column 200 are flush with the outside faces 14 of the panels 10, 50, 60. The column 200 is approximately as wide as the thickness of the panels 10, 50, 60 so that the opposite faces of the panels 10, 50, 60 form a clean corner as shown. Alternatively, the location of the inserts 204, and the thickness of the column 200, can be selected to provide a desired offset, for example to allow for interior or exterior finishing materials.

Figure 34:
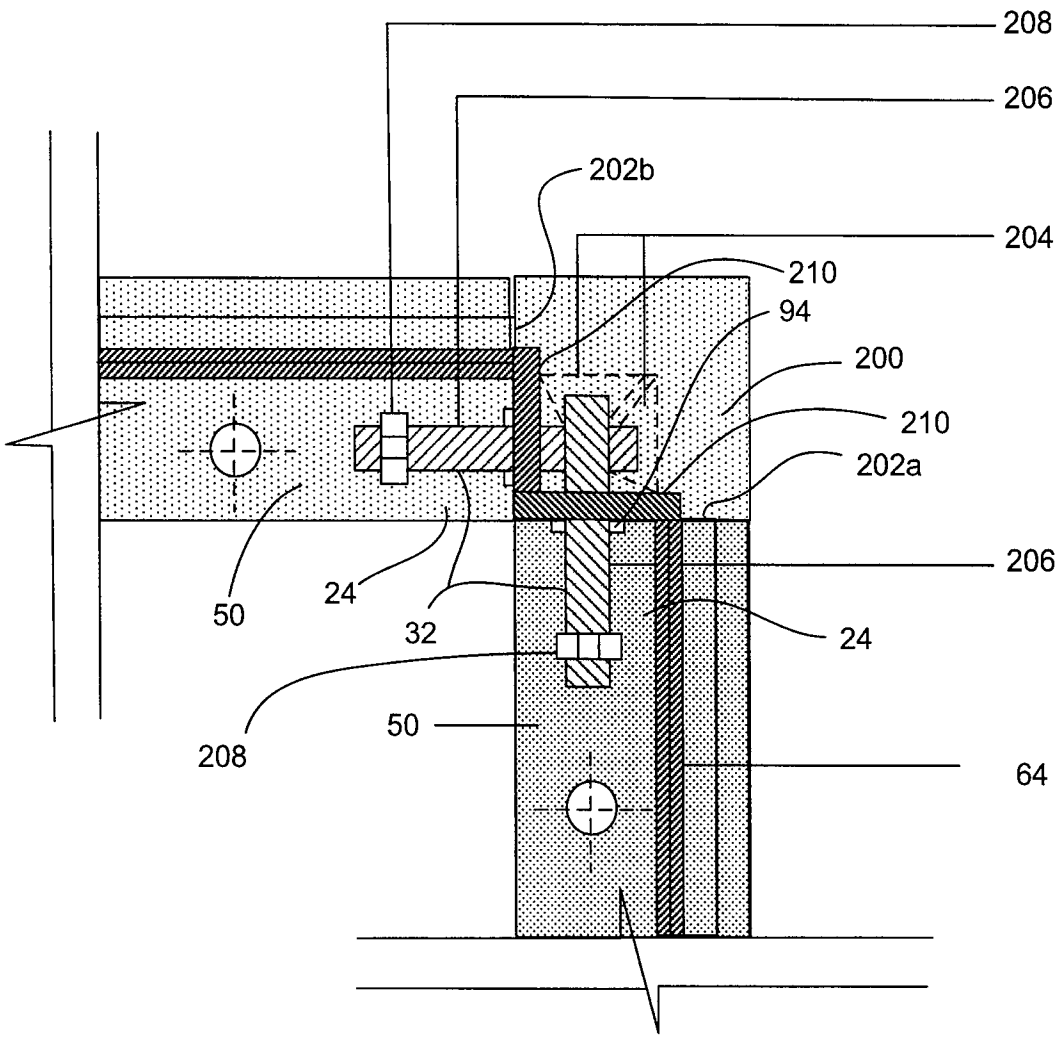
FIG. 34 shows two building panels connected to a column as in FIG. 30.

Column 200 is shown in FIG. 34 assembled to two panels 50 to make an exterior corner, that is a corner in which there is a 270 degree angle between the outside faces 14 of two panels 10, 50, 60. Alternatively, column 200 may be adapted for use in an interior corner, with a 90 degree angle between the outside faces 14 of two panels 10, 50, 60, or a straight wall. This is done by changing the location of inserts 204 so that the inserts are open to other faces 202 of the column 200. Other angles between two panels 10, 50, 60 can also be created by molding a column 200 with sides 202 that are not orthogonal to each other.

As shown in FIG. 34, to connect a panel 10, 50, 60 to a column 200 a fastener 206, 208 passes through a hole 32 in an end rib 24 and engages an insert 204. The fastener 206, 208 shown in FIG. 34 comprises an anchor bolt 206 and a nut 208.

Column 200 may optionally have insulation 210 on all or part of one or more faces 202. The insulation 210 may be sheets of compression bearing insulation, such as the insulation described above used between the slab 12 and ribs 22, 24 of panel 50. The insulation 210 may be held in place during forming by attaching it to the inside of the mold. If the insulation 210 is on a face 202 with inserts 204, then the inserts 204, temporarily bolted to the form, may hold the insulation 210 in place during forming. As shown in FIG. 34, the insulation 210 may extend from a corner of the column 200 by a distance that reaches the insulation 64 in panel 50. In this way, there is a continuous band of insulation around the wall. Alternatively, if insulation 210 is not cast into the column 200, the corner can be insulated from inside similar to what is shown in FIG. 35.

Figure 33:
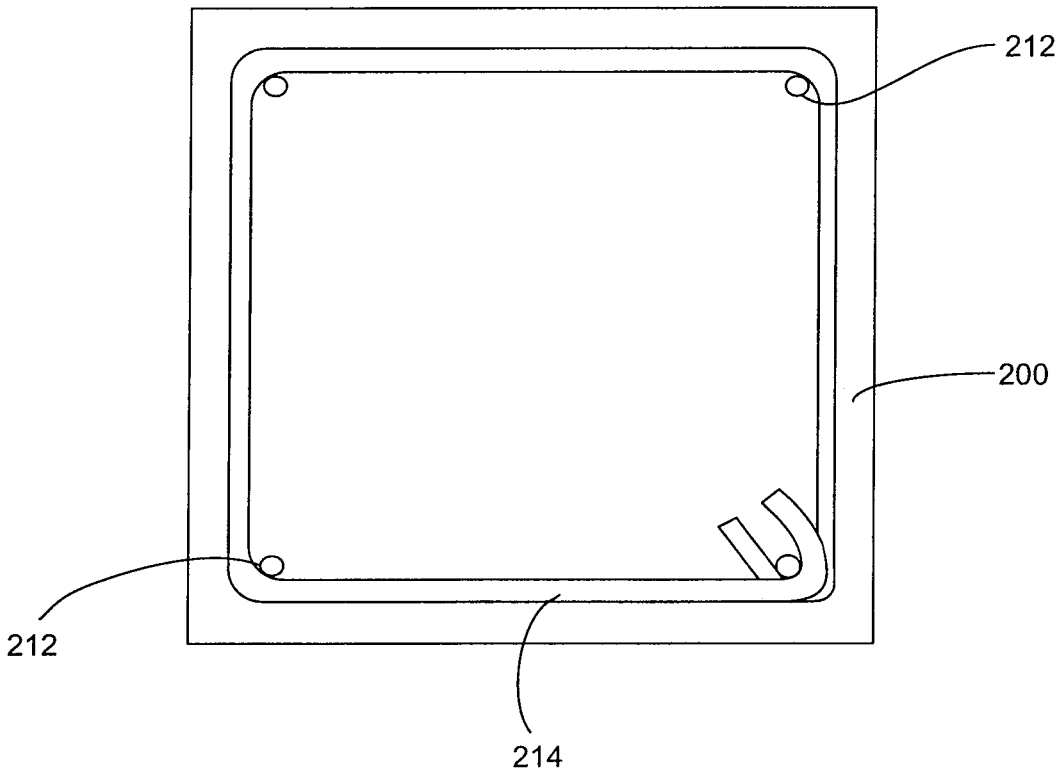
FIG. 33 shows a cross section of the column of FIG. 30 with reinforcing bar.

The column 200 may be internally reinforced as shown in FIG. 33. Reinforcing may include vertical (longitudinal) steel reinforcing bars 212, for example pencil rods, in the corners of the column 200. Reinforcing may also include horizontal ties 214 spaced along the height of the column 200, for example every 30 cm.

Figure 35:
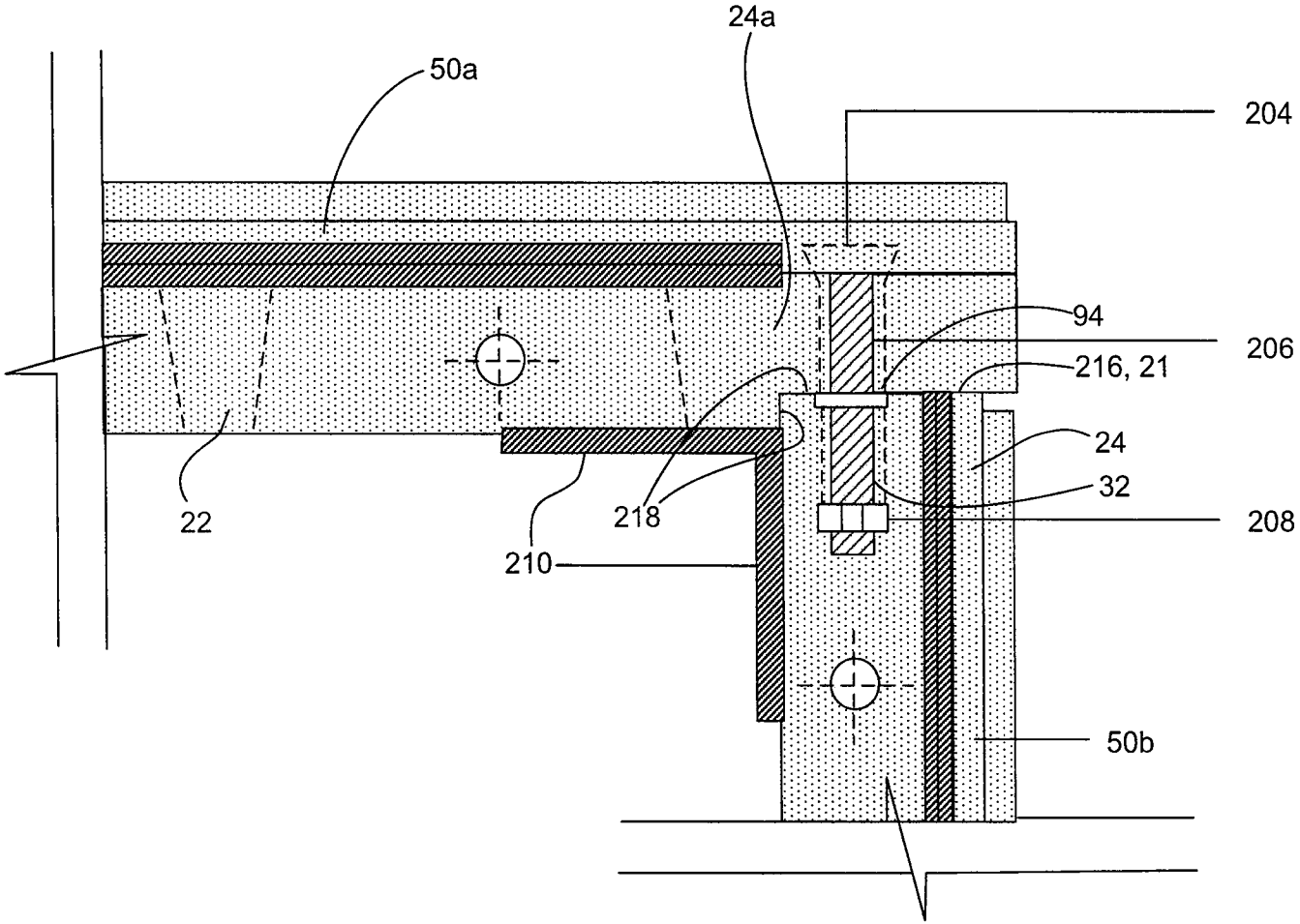
FIG. 35 shows a panel with a modified end rib connected to another panel.

FIG. 35 shows another corner connection between two panels 10, 50, 60. For this corner, a first panel 10, 50, 60 (50*a* in FIG. 35) is made with a widened end rib 24*a*. Widened end rib 24*a* is preferably made at least as wide as the thickness of a second panel 10, 50, 60 (50*b* in FIG. 35). A widened end rib 24*a* can be made by reducing the width of a corresponding sub form 142. The widened end rib 24*a* is further modified by forming a face 216 adapted to contact the side surface 21 of the second panel 10, 50, 60. In FIG. 35, the widened end rib 24*a* is wider than the thickness of the second panel 50*a* by about the width of an ordinary end rib 24 and the face 216 is indented relative to the remainder of the panel 50*a*. This forms an L-shaped notch 218 or rabbet sized to receive the edge of the second panel 50*b*.

The L-shaped notch 218 in FIG. 35 is formed by placing a form insert into form 132. For example, a nominal 2" by 12" piece of lumber can be ripped to a true 10 inch width (or another width corresponding to the thickness of the second panel 50*b*) and cut to a length corresponding to the height of the panel 50*a* for use as a form insert. The form insert can be attached to the form 132 before or after pouring the concrete to form the L-shaped notch 218, including face 216 which will be recessed from the inside of panel 50*a* by approximately 1.5 inches. Inserts 204 may be bolted to the form insert before forming in locations that will correspond with holes 32 in the end rib 24 of second panel 50*b*. The inserts 204 are thereby cast in place in locations such that the second panel 50*b* may be bolted to the first panel 50*a*, for example with anchor bolt 206 and nut 208, to make an exterior corner as shown.

The corner may be insulated by wrapping the inside of the corner with sheets of insulation 210. Optionally, the entire inside surfaces of panels 10, 50, 60 can be insulated by placing insulation between ribs 22, 24, or by attaching sheet insulation to the insides of the ribs 22, 24 or both. Further optionally, parallel strips of strapping may be attached to the ribs 22, 24, either vertically or horizontally, and sheets of insulation or interior wall materials attached to the strapping.

Figure 36:
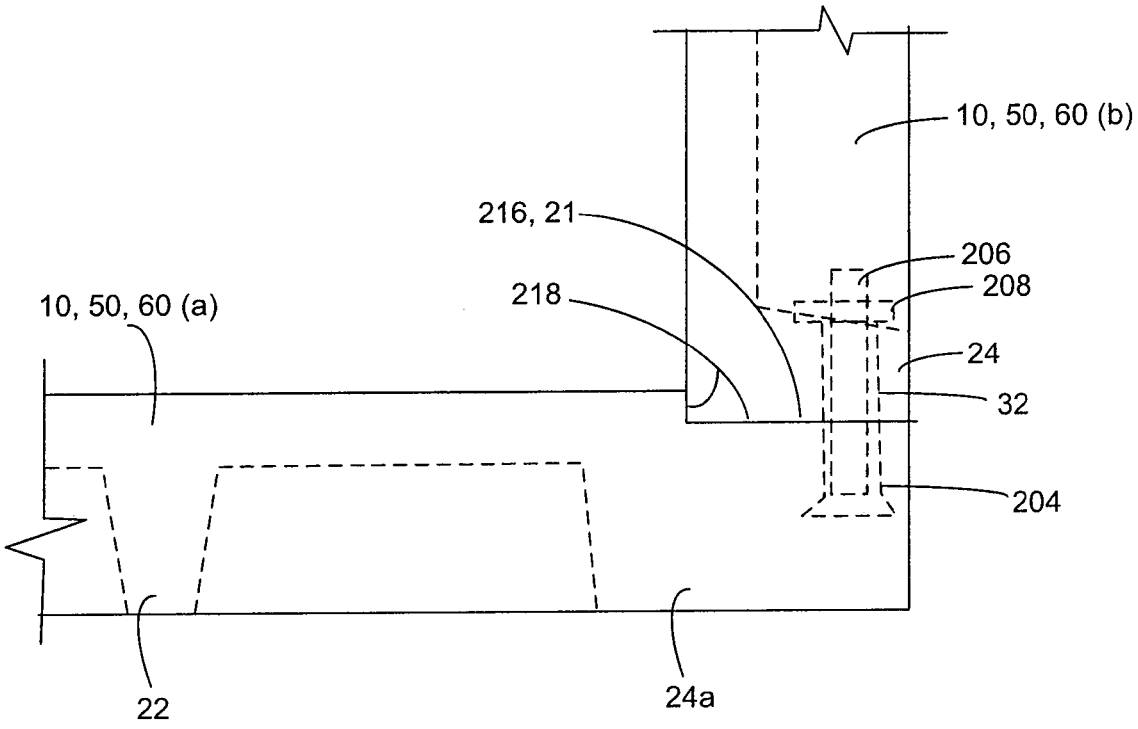
FIG. 36 shows another panel with a modified end rib connected to another panel.

An interior corner may be made as shown in FIG. 36 by making the L-shaped notch 218 in the outside face of widened rib 24*a*. This may be done by placing a form insert as described above in the bottom of form 132, along one side of the form 132 and with inserts 204 protruding upwards, before pouring the concrete. For an interior corner, the inserts 214 would preferably be moved towards the edge of panel 50*a* as required to make the inside face of panel 50*b* flush with the edge of panel 50*a*. In both forms of corner, the basket 160 of reinforcing bar is modified as required, preferably to avoid inserts 204 while still connecting the concrete surrounding inserts 204 to the remainder of the panel 50*a*.

In FIGS. 34 and 35, the slots 94 in panels 10. 50, 60 exist because they are cast in the same form 132 used to make panels 10, 50, 60 that connect edge to edge to other panels 10, 50, 60. However, the plate 96 may be omitted in the corner if there is sufficient reinforcing in column 200 or widened end rib 24*a*. Optionally, slot 94 of a panel 10, 50, 60 intended for a corner may be deepened and receive a plate 96. Further optionally, a slot 94 may be formed into column 200 or widened end rib 24*a* so that a plate 96 can be accommodated between a panel 10, 50, 60 and a column 200 or widened end rib 24*a*.

The description above includes an embodiment of each claimed invention. However, a particular method or apparatus described above might not be an embodiment of a particular claim. The claims do not necessarily include every method or apparatus described above, or features common to multiple methods or apparatus. A claimed invention may also include other methods or apparatus, not described above without departing from the scope of the claims.

I claim:

1. A wall system comprising, a) a first concrete wall panel having a first slab and a first end rib connected to the first slab, the first end rib and the first slab oriented generally vertically;

b) a second concrete wall panel having a second slab and a second end rib connected to the second slab, the second end rib and the second slab oriented generally vertically;

wherein each of the first and second wall panels has a first layer of insulation between the first slab and the first end rib, and between the second slab and the second end rib, respectively, and wherein each of the first and second end ribs has a plurality of end rib holes;

c) a column having at least two sides, a plurality of holes, a second layer of insulation recessed into parts of the two sides of the column, the second layer of insulation abutting the first layer of insulation of each of the first and second wall panels, the second layer of insulation extending continuously from the first layer of insulation of the first wall panel to the first layer of insulation of the second wall panel and wherein each side of the two sides of the column has at least two holes corresponding in location to two of the end rib holes of one of the first and second wall panels; and, d) fasteners passing through the end rib holes of each of the first and second wall panels and secured to the column such that one of the first and second wall panels is secured to each of two sides of the column.

2. The wall system of claim 1 having a third wall panel adapted to be mounted above the first or second wall panel, wherein the column extends above the top of the first and second wall panels and the third wall panel is fastened to the column.

3. The wall system of claim 1 wherein each of the first and second wall panels has at least four end rib holes spaced at the same elevations in both wall panels.

4. The wall system of claim 1 wherein the wall panels further comprise, vertical channels in the first end rib and the second end rib, the vertical channel and a face of the column forming a space; and a plate configured to fit into the space.

5. The wall system of claim 1 further comprising a reinforcing bar in each of the first and second end ribs, the reinforcing bar configured and located to surround the end rib holes.

6. The wall system of claim 1 wherein the holes of the column have threaded inserts cast in place.

7. The wall system of claim 1, wherein the second layer of insulation terminates at the first layer of insulation of each of the first and second wall panels.

* * * * *